US009176413B2

(12) United States Patent
Tatsuura et al.

(10) Patent No.: US 9,176,413 B2
(45) Date of Patent: Nov. 3, 2015

(54) LIQUID DEVELOPER, IMAGE FORMING APPARATUS, IMAGE FORMING METHOD, LIQUID DEVELOPER CARTRIDGE, AND PROCESS CARTRIDGE

(71) Applicant: FUJI XEROX CO., LTD., Tokyo (JP)

(72) Inventors: Satoshi Tatsuura, Kanagawa (JP); Keitaro Mori, Kanagawa (JP); Nobuhiro Katsuta, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/186,024

(22) Filed: Feb. 21, 2014

(65) Prior Publication Data

US 2014/0242513 A1 Aug. 28, 2014

Related U.S. Application Data

(63) Continuation-in-part of application No. 13/969,638, filed on Aug. 19, 2013, now abandoned.

(30) Foreign Application Priority Data

Feb. 25, 2013 (JP) ..... 2013-035086
Feb. 6, 2014 (JP) ..... 2014-021615

(51) Int. Cl.

| | |
|---|---|
| ***G03G 9/00*** | (2006.01) |
| ***G03G 13/10*** | (2006.01) |
| ***G03G 15/10*** | (2006.01) |
| ***G03G 9/12*** | (2006.01) |
| ***G03G 9/125*** | (2006.01) |
| ***G03G 9/13*** | (2006.01) |

(52) U.S. Cl.
CPC ..... *G03G 9/12* (2013.01); *G03G 9/125* (2013.01); *G03G 9/132* (2013.01); *G03G 13/10* (2013.01)

(58) Field of Classification Search
CPC ..... G03G 9/12; G03G 13/10
USPC ..... 430/117.1, 123.53, 124.3; 399/237
See application file for complete search history.

(56) References Cited

U.S. PATENT DOCUMENTS

| | | | | |
|---|---|---|---|---|
| 7,892,717 | B2 * | 2/2011 | Sato et al. | 430/111.4 |
| 2009/0253066 | A1 * | 10/2009 | Yamada | 430/109.4 |

FOREIGN PATENT DOCUMENTS

| | | |
|---|---|---|
| JP | 2003-098864 | 4/2003 |
| JP | 2005-062466 | 3/2005 |

* cited by examiner

*Primary Examiner* — Thorl Chea
(74) *Attorney, Agent, or Firm* — Fildes & Outland, P.C.

(57) ABSTRACT

There is provided a liquid developer containing a toner that has a ratio G'(65)/G'(90) of a storage modulus G'(65) at 65° C. to a storage modulus G'(90) at 90° C. of from $1\times10$ to $1\times10^3$, and a carrier liquid that has a difference ΔSP(tc) of SP value between the carrier liquid and the toner of from 1.5 to 7.0, and an image forming apparatus containing an electrostatic latent image holding member, a charging device, a latent image forming device, a developing device, a transfer device and a fixing device.

10 Claims, 5 Drawing Sheets

LIQUID DEVELOPER, IMAGE FORMING APPARATUS, IMAGE FORMING METHOD, LIQUID DEVELOPER CARTRIDGE, AND PROCESS CARTRIDGE

CROSS-REFERENCE TO RELATED APPLICATIONS

This is a Continuation-In-Part application of U.S. application Ser. No. 13/969,638 filed in the United States on Aug. 19, 2013; the entire content of which is hereby incorporated by reference.

Further, this application is based on and claims priority under 35 USC 119 from Japanese Patent Application No. 2014-021615 filed on Feb. 6, 2014.

BACKGROUND

1. Field

The present invention relates to a liquid developer, an image forming apparatus, an image forming method, a liquid developer cartridge, and a process cartridge.

2. Description of the Related Art

Conventionally, an electrophotographic image forming apparatus and an electrophotographic image forming method which use a liquid developer including a toner dispersed in a carrier liquid as a developer have been known.

For example, Japanese Patent Application Laid-Open No. 2003-98864 discloses an image forming apparatus which is provided with a non-contact heating unit configured to heat an unfixed image on a recording medium in a non-contact manner, that is, an image fixing device configured to heat and fix the unfixed image formed using a liquid developer including a toner dispersed in a non-volatile solvent, on the recording medium, and a solvent removing unit configured to remove a precipitated solvent precipitated by heating of the non-contact heating unit from the surface of the image.

Also, Japanese Patent Application Laid-Open No. 2005-62466 discloses an image forming apparatus using an electrostatic image developing liquid developer in which the electrostatic image developing liquid developer contains toner particles (containing a coloring agent and a resin) dispersed in a carrier liquid, and the resin component contains, as a main component, a crystalline polyester resin of which melt mass flow rate measured at 150±0.4° C. under a load of 2160±10 g in accordance with JIS K7210 ranges from 10 g/10 min to 1200 g/10 min.

SUMMARY

[1] A liquid developer containing:

a toner that has a ratio G'(65)/G'(90) of a storage modulus G'(65) at 65° C. to a storage modulus G'(90) at 90° C. of from $1\times10$ to $1\times10^3$, and a carrier liquid that has a difference ΔSP(tc) of SP value between the carrier liquid and the toner of from 1.5 to 7.0.

BRIEF DESCRIPTION OF DRAWINGS

Exemplary embodiments of the present invention will be described in detail based on the following figures, wherein.

DETAILED DESCRIPTION

Figure 1:
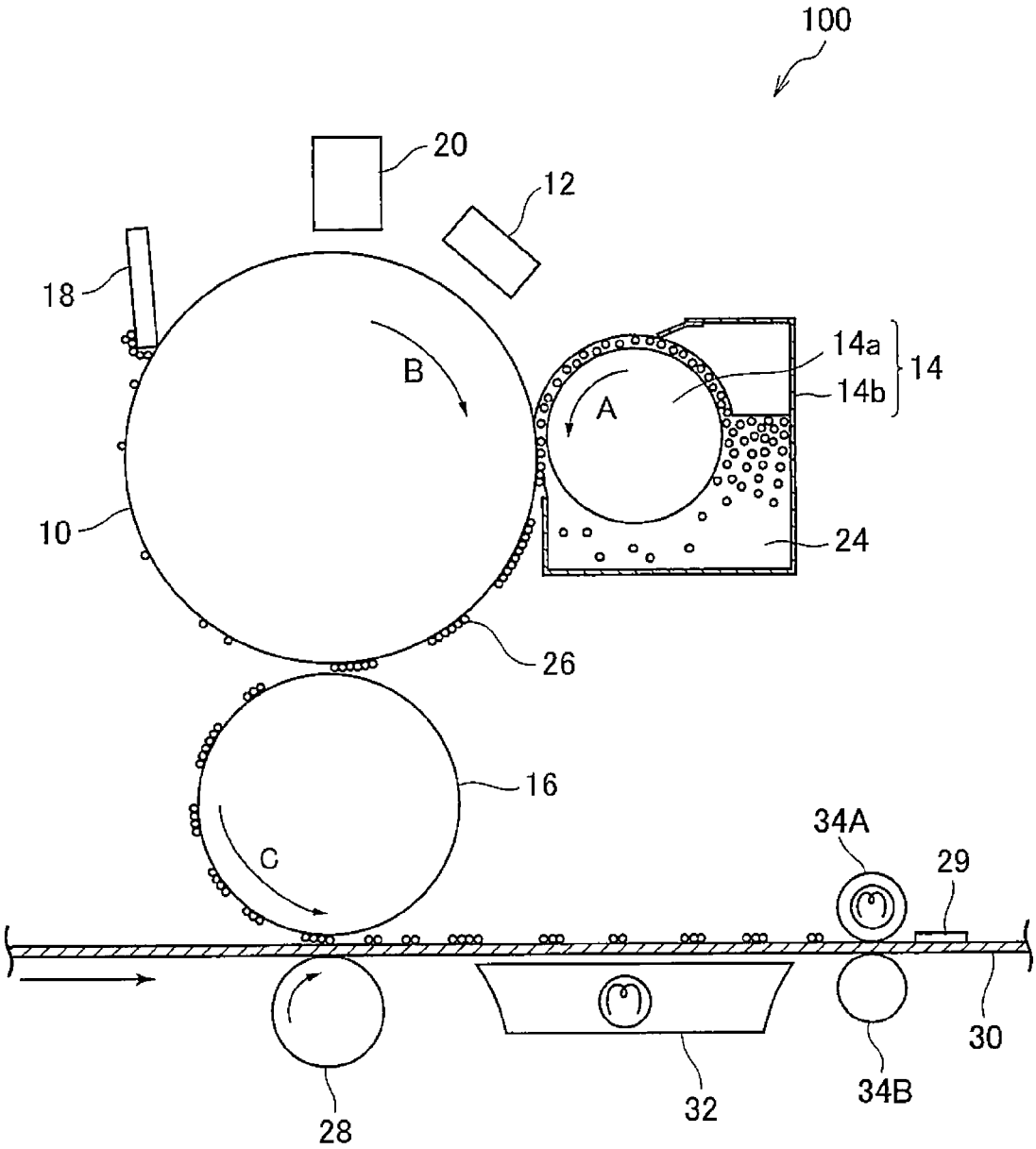
FIG. 1 is a schematic configuration view illustrating one example of an image forming apparatus according to the present exemplary embodiment.

Hereinafter, exemplary embodiments of a liquid developer, an image forming apparatus, an image forming method, a liquid developer cartridge, and a process cartridge of the present invention will be described in detail.

A liquid developer according to the present exemplary embodiment contains a toner and a carrier liquid. The toner has a ratio G'(65)/G'(90) of a storage modulus G'(65) at 65° C. to a storage modulus G'(90) at 90° C. of from $1\times10$ to $1\times10^3$. Moreover, a difference ΔSP(tc) in SP value between the carrier liquid and the toner ranges from 1.5 to 7.0.

When a liquid developer is used to form an image, fixability may be degraded due to remaining of a carrier liquid among toners at the time of fixation, and especially in a case of using a non-volatile carrier liquid, such a phenomenon is further significant.

In contrast, in the present exemplary embodiment, between the toner and the carrier liquid, a difference ΔSP(tc) of SP value is 1.5 or more, and they are combined with a low affinity. As the toner, a toner which has a ratio G'(65)/G'(90) of a storage modulus G'(65) at 65° C. to a storage modulus G'(90) at 90° C. of from $1\times10$ to $1\times10^3$, and a storage modulus subject to sudden change by heating is used.

First, due to a first characteristic that the difference ΔSP(tc) of SP value between the toner and the carrier liquid is 1.5 or more, it is assumed that in a fixing process, the carrier liquid may be easily separated from toners, and the carrier liquid is suppressed from remaining in a fixed image. It is thought that the toners may be strongly combined to each other by suppressing the carrier liquid from remaining in the fixed image, and as a result, it is assumed that a high fixing strength between the toners is achieved.

Further, a second characteristic that the ratio G'(65)/G'(90) of a storage modulus G'(65) at 65° C. to a storage modulus G'(90) at 90° C. of the toner ranges from $1\times10$ to $1\times10^3$ indicates that the toner has an elastic modulus subject to sudden change at a temperature ranging from 65° C. to 90° C.

Here, separation of the toner from the carrier liquid is thought to be caused by the reason that the molten toner bounces the carrier liquid by surface tension due to difference in affinity. However, it is considered that when a gap between toners is not filled due to the presence of unmolten toners remaining after a melting process of the toner at the time of fixation, the carrier liquid enters among the toners and becomes a residual carrier liquid, thereby causing a degradation of fixability.

In contrast, when the toner having an elastic modulus subject to sudden change, as above, is used, it is assumed that unmolten toners are suppressed from remaining after a melting process at the time of fixation, and thereby a gap between toners is reduced, and the carrier liquid is suppressed from remaining in a fixed image. It is thought that the toners may be strongly combined to each other by suppressing the carrier liquid from remaining in the fixed image, and as a result, it is assumed that high fixability between the toners is achieved.

Further, in the image forming apparatus and the image forming method according to the present exemplary embodiment, it is preferable that a difference ΔSP(pt) of SP value between a recording medium and the toner is smaller than a difference ΔSP(pc) of SP value between the recording medium and the carrier liquid. When SP values of the recording medium, the toner and the carrier liquid are adjusted to satisfy the above relationship, it is assumed that affinity between the toner and the recording medium becomes higher than affinity between the carrier liquid and the recording medium, and thereby the carrier liquid is suppressed from entering between the toner and the recording medium at the time of fixation, and a high fixing strength between the recording medium and the toner (fixed image) is achieved.

Also, in the image forming apparatus and the image forming method according to the present exemplary embodiment, it is desirable that in a fixing device (fixing step), the fixation is performed in two stages. That is, the apparatus and method desirably include a first heating device (first heating step) for heating a toner image in a non-contact manner up to a temperature not less than a temperature (A) at which a storage modulus of the toner in the toner image reaches $1\times10^6$ Pa, and a second heating/pressurizing device (second heating/pressurizing step) for applying pressure while heating at the temperature not less than the temperature (A) after the heating in the first heating device (first heating step).

In the first heating device (first heating step), the heating up to the temperature not less than the temperature (A) at which a storage modulus of the toner reaches $1\times10^6$ Pa softens and melts the toner, causing a sudden change in an elastic modulus. Then, the toner with a reduced elastic modulus is pressurized while heated in the second heating/pressurizing device (second heating/pressurizing step), thereby forming a fixed image. Since in the first heating device (first heating step), the elastic modulus is previously subject to sudden change, it is assumed that unmolten toners are suppressed at the time of fixation by the second heating/pressurizing device (second heating/pressurizing step), and thereby a gap between toners is reduced, and the carrier liquid is suppressed from remaining in the fixed image.

Storage Modulus

In the liquid developer according to the present exemplary embodiment, the toner has a ratio G'(65)/G'(90) of a storage modulus G'(65) at 65° C. to a storage modulus G'(90) at 90° C. of from $1\times10$ to $1\times10^3$.

When the ratio G'(65)/G'(90) of the storage modulus is less than $1\times10$, there is a case where a fixing temperature has to be increased because a viscosity required for fixation is not obtained, and when the ratio is greater than $1\times10^3$, there is a case where hot offset resistance or fixing strength is not achieved. Also, a more preferable value of G'(65)/G'(90) ranges from $1\times10$ to $5\times10^2$.

It is preferable that a storage modulus G'(65) at 65° C. ranges from $1\times10^7$ Pa to $1\times10^8$ Pa, and a storage modulus (G') 90 at 90° C. ranges from $1\times10^5$ Pa to $1\times10^6$ Pa.

At a storage modulus G'(65) at 65° C. of $1\times10^7$ Pa or more, heat resistance is achieved at the time of storage when the toner is contained within the liquid developer cartridge or a developing device of the image forming apparatus. Also, at $1\times10^8$ Pa or less, sufficient fixing strength is achieved at a required fixing temperature.

Meanwhile, at a storage modulus G'(90) at 90° C. of $1\times10^5$ Pa or more, hot offset is suppressed from occurring at the time of fixation. Also, at $1\times10^6$ Pa or less, the carrier liquid is suppressed from remaining in a fixed image, and thus excellent fixing strength is achieved.

Also, the storage modulus of the toner is obtained from a dynamic viscoelasticity measured by a sine wave vibration method. In the measurement of the dynamic viscoelasticity, an ARES measuring device manufactured by Rheometric Scientific Inc. is used. In the measurement of the dynamic viscoelasticity, the toner is formed into tablets, and set on a parallel plate with a diameter of 8 mm, and the normal force is set to be 0, and a sine wave vibration is provided at vibration frequency of 1 rad/sec. The measurement is initiated from 20° C., and is continued to 100° C. In the measurement, a time interval is 30 seconds, and heating is performed at 1° C./min.

Before the measurement, at an interval of 10° C. from 20° C. to 100° C., stress dependency of a distortion amount is determined, and at each temperature, a distortion amount range in which stress and distortion amount are placed in a linear relation is obtained. During the measurement, in each measurement temperature, the distortion amount is maintained in a range from 0.01% to 0.5%, and in all measurement temperature areas, the stress and the distortion amount are controlled to be in a linear relation. From the result of such measurement, storage modulus is obtained.

Also, a control method of a value of the storage modulus will be described in detail below.

Difference ΔSP(Tc) in SP Value Between Toner and Carrier Liquid

In the liquid developer according to the present exemplary embodiment, the difference ΔSP(tc) in SP value between the toner and the carrier liquid ranges from 1.5 to 7.0. The ΔSP (tc) preferably ranges from 1.5 to 6.0, and more preferably from 1.7 to 5.7.

When the ΔSP(tc) is less than 1.5, remaining of the carrier liquid in a fixed image may occur, thereby reducing fixing strength. Also, when the ΔSP(tc) is greater than 7.0, dispersibility of the toner into the carrier liquid is lowered.

Here, a calculating method of an SP value will be described. The SP value is a square root of density of cohesive energy, and in the present exemplary embodiment, an SP value of the toner, an SP value of the carrier liquid, and an SP value of the recording medium are calculated by the following method.

Calculation of the SP value is carried out by an estimation method of Van Krevelen and Hoftyzer. In the method, it is considered that the cohesive energy density depends on the species and number of substituents, and based on a cohesive energy value determined for each substituent, an SP value of a polymer is calculated by a segment unit. Most of cohesive energy values calculated by the above method are within the range of experimental values, and are highly practicable values. The SP value is obtained by dividing a cohesive energy by a molar volume of a material, and subtracting a square root (reference document: SP value Basics/Applications and Calculation Method, written by Hideki Yamamoto, Information Mechanism Co., Ltd, publication in 2005).

Also, the SP value is conventionally calculated in a unit of $cal^{1/2}/cm^{3/2}$, and then is non-dimensionally expressed. Further, in the present specification, since a relative difference in SP value between two compounds has a significance, the conventionally calculated value is employed and non-dimensionally expressed.

Also, for reference, the SP value may be converted to SI unit ($J^{1/2}/m^{3/2}$) by multiplying by 2046.

<Liquid Developer>

The configuration of the liquid developer according to the present exemplary embodiment will be described in detail.

[Toner]

The toner in the present exemplary embodiment has a ratio G'(65)/G'(90) of a storage modulus G'(65) at 65° C. to a storage modulus G'(90) at 90° C. of from $1\times10$ to $1\times10^3$.

Also, it is preferable that the toner in the present exemplary embodiment has a storage modulus of from $1\times10^7$ Pa to $1\times10^8$ Pa at 65° C., and a storage modulus of from $1\times10^5$ Pa to $1\times10^6$ Pa at 90° C.

Also, the toner satisfying the requirement of the storage modulus may be obtained by containing a crystalline resin in the toner and allowing the storage modulus to be suddenly changed according to temperature, but is not limited thereto. More preferably, the toner satisfying the requirement of the storage modulus may be more easily obtained by preparation by the following preparation method or by including the following composition.

Also, a toner satisfying the requirement of the storage modulus may be more easily obtained, when in the toner, the existence ratio (XPS (X-ray photoelectron spectroscopy)) of group IA elements (except for hydrogen) ranges from 0.03 atom % to 1.0 atom %, and the sum of existence ratio of group IIA elements, group IIIB elements and group IVB elements (except for carbon) ranges from 0.05 atom % to 2.0 atom %.

Specifically, first, after ion etching by XPS (X-ray photoelectron spectroscopy), the existence ratio of the group IA elements (except for hydrogen) preferably ranges from 0.03 atom % to 1.0 atom %. The existence ratio also more preferably ranges from 0.04 atom % to 0.8 atom %, and further preferably from 0.1 atom % to 0.6 atom %.

Also, the group IA elements preferably include Na and K.

The sum of existence ratios of the group IIA elements, the group IIIB elements and the group IVB elements (except for carbon) preferably ranges from 0.05 atom % to 2.0 atom %. The existence ratio more preferably ranges from 0.06 atom % to 1.80 atom %, and further preferably ranges from 0.1 atom % to 1.5 atom %.

Preferably, the group IIA elements include Mg and Ca, and the group IIIB elements include Al, and the group IVB elements include Si.

The XPS measurement is performed using a device of JPS9000MX manufactured by JEOL Ltd. Also, the measurement condition includes an accelerating voltage of 10 kV, and a current value of 30 mA. The measured value is that obtained after ion etching is performed for 180 seconds at an accelerating voltage of 400 V and a vacuum of from 1 Pa to $10^{-2}$ Pa, under Ar atmosphere (depth from a toner particle surface ranges from 1 nm to 10 nm).

First, the constituent materials of the toner in the present exemplary embodiment will be described in detail.

Preferably, the toner in the present exemplary embodiment contains a binder resin and a coloring agent.

(Binder Resin)

Preferably, from the viewpoint of low-temperature fixability, and storage stability, the binder resin used in the toner of the present exemplary embodiment is that synthesized by a polyaddition reaction or a polycondensation reaction, but is not particularly limited thereto. Specifically, examples thereof may include a polyester resin, a polyurethane resin, an epoxy resin, and a polyol resin. Among them, preferably, the polyester resin is used from the viewpoints of internal-containing of a release agent, and compatibility with a crystalline resin to be used in combination.

As above, in the present exemplary embodiment, preferably, as the binder resin, besides an amorphous resin, the crystalline resin is used from the viewpoint of obtaining a sharp melting characteristic at the time of fixation.

Also, in the present exemplary embodiment "crystalline resin" refers to a matter having a distinct endothermic peak but not a stepwise endothermic change in the differential scanning calorimetry (DSC), and indicates at least a crystalline resin having a weight average molecular weight of 5000 or more, and generally a crystalline resin having a weight average molecular weight of 10000 or more.

—Crystalline Resin—

The crystalline resin may give further excellent low-temperature fixability because it has a melting temperature, and thus significantly reduces a viscosity at a specific temperature, and upon heating of the toner at the time of fixation, may reduce the difference between the temperature upon initiation of thermal activity of crystalline resin molecules and the temperature at which fixation is feasible. In toner particles, the crystalline resin is preferably included in an amount of from 1% by mass to 10% by mass, and more preferably from 2% by mass to 8% by mass.

It is appropriate that the crystalline resin used in the present exemplary embodiment has a melting temperature within a range of from 45° C. to 110° C. in order to secure low-temperature fixability, and storage stability of the toner. More preferably, the melting temperature ranges from 50° C. to 100° C., and further more preferably ranges from 55° C. to 90° C. The melting temperature of the resin is obtained by a method in accordance with ASTMD3418-8.

Also, the number average molecular weight (Mn) of the crystalline resin is preferably 2000 or more, and more preferably 4000 or more.

The crystalline resin used in the present exemplary embodiment is preferably a resin which has a weight average molecular weight of greater than 5000 and has crystallinity, and specifically, may be a crystalline polyester resin or a crystalline vinyl-based resin. Among them, the crystalline polyester resin is preferred. Also, an aliphatic-based crystalline polyester resin that has a proper melting temperature is more preferred.

Examples of the crystalline vinyl-based resin may include vinyl-based resins using long-chain alkyl or alkenyl (meth) acrylic acid esters such as amyl (meth)acrylate, hexyl (meth) acrylate, heptyl (meth)acrylate, octyl (meth)acrylate, nonyl (meth)acrylate, decyl (meth)acrylate, undecyl (meth)acrylate, tridecyl (meth)acrylate, myristyl(meth)acrylate, cetyl (meth)acrylate, stearyl(meth)acrylate, oleyl(meth)acrylate, and behenyl(meth)acrylate. In the present specification, it is meant that the term "(meth)acryl" includes both of "acryl" and "methacryl".

Meanwhile, the crystalline polyester resin is that synthesized from a carboxylic acid (dicarboxylic acid) component and an alcohol (diol) component. Hereinafter, the carboxylic acid component and the alcohol component will be described in more detail. Also, in the present exemplary embodiment, the crystalline polyester resin includes a copolymer prepared by copolymerizing a crystalline polyester resin with another component in an amount of 50% by mass or less based on a main chain of the crystalline polyester resin.

The carboxylic acid component is preferably an aliphatic dicarboxylic acid, and particularly preferably a linear carboxylic acid. Examples thereof may include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid; and lower alkyl esters and acid anhydrides thereof, but are not limited thereto.

The carboxylic acid component preferably includes constituents such as a dicarboxylic acid component having a double bond and a dicarboxylic acid component having a sulfonic acid group, other than the above described aliphatic dicarboxylic acid component. Also, the dicarboxylic acid component having a double bond includes not only constituents derived from dicarboxylic acids having double bonds, but also constituents derived from lower alkyl esters or acid anhydrides of dicarboxylic acids having double bonds. The dicarboxylic acid component having a sulfonic acid group includes not only constituents derived from dicarboxylic acids having sulfonic acid groups but also constituents derived from lower alkyl esters or acid anhydrides of dicarboxylic acids having sulfonic acid groups.

The dicarboxylic acid having a double bond may be used suitably in crosslinking the entire resin by utilizing double bonds therein. Examples of the dicarboxylic acid may include, but are not limited to, fumaric acid, maleic acid, 3-hexenedioic acid and 3-octenedioic acid, and may include lower alkyl esters and acid anhydrides thereof. Among them, fumaric acid, maleic acid etc. are preferable from the viewpoint of costs.

The dicarboxylic acid having a sulfonic acid group is effective in improving dispersion of a coloring material such as a pigment. When the entire resin is emulsified or suspended in water to form particles, presence of the sulfonic acid group enables the emulsification or suspension without a surfactant as will be described hereinafter. Examples of the dicarboxylic acid having a sulfonic acid group include, but are not limited to, sodium 2-sulfoterephthalate salt, sodium 5-sulfoisophthalate salt and sodium sulfosuccinate salt, and may include lower alkyl esters and acid anhydrides thereof. Among them, sodium 5-sulfoisophthalate salt or the like is preferable from the viewpoint of costs.

The content of the carboxylic acid component other than the aliphatic dicarboxylic acid component in the carboxylic acid component (the dicarboxylic acid component having a double bond and/or the dicarboxylic acid component having a sulfonic acid group) preferably ranges from 1% to 20% by constitutional mole, more preferably from 2% to 10% by constitutional mole.

In the present exemplary embodiment, "% by constitutional mole" means a percentage when the respective constituents (carboxylic acid component, alcohol component) in the polyester resin are each defined as one unit (by mole).

As the alcohol constituent, aliphatic diol is preferred, and examples thereof may include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol, but not limited thereto.

In the alcohol component, a content of the aliphatic diol component is preferably about 80% by constitutional mole or more, and other components may be contained. In the alcohol component, the content of the aliphatic diol component is more preferably about 90% by constitutional mole or more.

Examples of other components may include constituents such as a diol component having a double bond and a diol component containing a sulfonic acid group.

Examples of the diol having a double bond may include 2-butene-1,4-diol, 3-butene-1,6-diol, and 4-butene-1,8-diol. Examples of the diol having a sulfonic acid group may include a sodium 1,4-dihydroxy-2-benzenesulfonate salt, sodium 1,3-dihydroxymethyl-5-benzenesulfonate salt, and sodium 2-sulfo-1,4-butanediol salt.

In a case where an alcohol component (a diol component having a double bond or a diol component having a sulfonic acid group) other than the linear aliphatic diol component is added, a content thereof preferably ranges from 1% to 20% by constitutional mole, and more preferably from 2% to 10% by constitutional mole, in the alcohol component.

There is no particular limitation in the preparation method of the crystalline polyester resin. A general polyester polymerization method, in which a carboxylic acid component is reacted with an alcohol component, may be used. For example, a direct polycondensation method, an ester interchange method, or the like may be used, which is selected depending on the kinds of monomers. The molar ratio of the acid component to the alcohol component (acid component/alcohol component) to be reacted with each other varies depending on reaction conditions etc., and cannot be generalized, but is usually about 1/1.

The preparation of the crystalline polyester resin is carried out at a polymerization temperature of from 180° C. to 230° C., and the reaction is performed while removing water or alcohol generated at the time of condensation. Also, the pressure within the reaction system may be reduced. In a case where monomers are insoluble or incompatible at the reaction temperature, the monomers may be dissolved by adding a solvent having a high boiling temperature as an auxiliary agent for dissolution. In the polycondensation reaction, the reaction is carried out while distilling off the auxiliary solvent for dissolution. In a case where a monomer having poor compatibility is present in the copolymerization reaction, the monomer having poor compatibility may be previously condensed with a carboxylic acid component or an alcohol component to be polycondensed with the monomer, followed by polycondensation together with the main components.

Examples of a catalyst that may be used at the time of preparing the crystalline polyester resin may include compounds of an alkali metal such as sodium and lithium; compounds of an alkaline earth metal such as magnesium and calcium; compounds of a metal such as zinc, manganese, antimony, titanium, tin, zirconium and germanium; phosphorous acid compounds; phosphoric acid compounds; and amine compounds, and specifically, include following compounds.

Examples thereof may include compounds such as sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-di-t-butylphenyl)phosphite, ethyl triphenylphosphonium bromide, triethylamine and triphenylamine.

In order to regulate the melting temperature, molecular weight etc. of the crystalline resin, in addition to the polymerizable monomers described above, compounds having a shorter-chain alkyl or alkenyl group, an aromatic ring, etc. may be used.

Examples thereof may include, for the dicarboxylic acid, alkyl dicarboxylic acids such as succinic acid, malonic acid and oxalic acid, aromatic dicarboxylic acids such as phthalic acid, isophthalic acid, terephthalic acid, homophthalic acid, 4,4'-bibenzoic acid, 2,6-naphthalene dicarboxylic acid and 1,4-naphthalene dicarboxylic acid, and nitrogen-containing aromatic dicarboxylic acids such as dipicolinic acid, dinicotinic acid, quinolinic acid and 2,3-pyrazine dicarboxylic acid; for the diols, short-alkyl diols such as succinic acid, malonic acid, acetone dicarboxylic acid and diglycolic acid; and for the vinyl-based polymerizable monomers containing the short-chain alkyl group, short-chain alkyl or alkenyl (meth) acrylic acid esters such as methyl (meth)acrylate, ethyl (meth)acrylate, propyl (meth)acrylate and butyl (meth)acrylate, vinyl nitriles such as acrylonitrile and methacrylonitrile, vinyl ethers such as vinyl methyl ether and vinyl isobutyl ether, vinyl methyl ketone, vinyl ethyl ketone, vinyl isopropenyl ketones, and olefins such as ethylene, propylene, butadiene and isoprene. These polymerizable monomers may be used alone or two or more thereof may be used in combination.

—Amorphous Resin—

As the amorphous resin used in the present exemplary embodiment, a conventionally known amorphous binder resin for a toner is used. For example, a styrene-acrylic resin or the like may be used, but an amorphous polyester resin is suitably used.

The glass transition temperature (Tg) of the amorphous polyester resin to be used preferably ranges from 50° C. to 80° C., and more preferably from 55° C. to 65° C. The weight average molecular weight preferably ranges from 8000 to 30000, and more preferably from 8000 to 16000. A third component may be copolymerized.

The amorphous polyester resin preferably contains the same alcohol component or carboxylic acid component as in the crystalline polyester compound to be used in combination in order to improve miscibility.

There is no particular limitation in the preparation method of the amorphous polyester resin, and the amorphous polyester resin may be prepared by a general polyester polymerization method as described above.

As the carboxylic acid component used in synthesis of the amorphous polyester resin, various dicarboxylic acids exemplified for the crystalline polyester resin may be used. As the alcohol component, various diols used in synthesis of the amorphous polyester resin may be used, and it is possible to use bisphenol A, bisphenol A/ethylene oxide adduct, bisphenol A/propylene oxide adduct, hydrogenated bisphenol A, bisphenol S, bisphenol S/ethylene oxide adduct, bisphenol S/propylene oxide adduct, etc, in addition to the aliphatic diols exemplified for the crystalline polyester resin.

From the viewpoints of toner productivity, heat resistance and transparency, bisphenol S and bisphenol S derivatives such as bisphenol S/ethylene oxide adduct and bisphenol S/propylene oxide adduct are particularly preferably used. The carboxylic acid component or the alcohol component may contain plural components, and particularly, bisphenol S has an effect of improving heat resistance.

Hereinafter, a copolymerizable component that may be used in crosslinking of the amorphous resin or the crystalline resin used as the binder resin, or synthesis of the binder resin will be described.

In the synthesis of the binder resin, other components may be copolymerized, and compounds having hydrophilic polar groups may be used.

When the binder resin is a polyester resin, specific examples of other components may include dicarboxylic acid compounds having an aromatic ring substituted directly with a sulfonyl group, such as sodium sulfonyl-terephthalate salt and sodium 3-sulfonyl isophthalate salt. When the binder resin is a vinyl-based resin, specific examples of other components may include unsaturated aliphatic carboxylic acids such as (meth)acrylic acid and itaconic acid, esters of (meth) acrylic acids and alcohols, such as glycerin mono(meth)acrylate, fatty acid-modified glycidyl(meth)acrylate, zinc mono (meth)acrylate, zinc di(meth)acrylate, 2-hydroxyethyl(meth) acrylate, polyethylene glycol(meth)acrylate and polypropylene glycol(meth)acrylate, styrene derivatives having a sulfonyl group in the ortho-, meta- or para-position, and a sulfonyl group-substituted aromatic vinyl such as sulfonyl group-containing vinyl naphthalene and the like.

In the binder resin, a crosslinking agent may be added.

Specific examples of the crosslinking agent may include aromatic polyvinyl compounds such as divinyl benzene and divinyl naphthalene, polyvinyl esters of aromatic polyvalent carboxylic acids such as divinyl phthalate, divinyl isophthalate, divinyl terephthalate, divinyl homophthalate, divinyl/trivinyl trimesate, divinyl naphthalene dicarboxylate and divinyl biphenyl carboxylate, divinyl esters of nitrogen-containing aromatic compounds, such as divinyl pyridine dicarboxylate, unsaturated heterocyclic compounds such as pyrrole and thiophene, vinyl esters of unsaturated heterocyclic carboxylic acids, such as vinyl pyromucate, vinyl furan carboxylate, vinyl pyrrole-2-carboxylate and vinyl thiophene carboxylate, (meth)acrylic acid esters of linear polyvalent alcohols, such as butane diol methacrylate, hexane diol acrylate, octane diol methacrylate, decane diol acrylate and dodecane diol methacrylate, (meth)acrylic acid esters of branched, substituted polyvalent alcohols such as neopentyl glycol dimethacrylate, and 2-hydroxy-1,3-diacryloxy propane, and polyvinyl esters of polyvalent carboxylic acids such as polyethylene glycol di(meth)acrylate, polypropylene polyethylene glycol di(meth)acrylates, divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, dodecane diacid divinyl, divinyl brassylate etc.

Particularly in the crystalline polyester resin, unsaturated polycarboxylic acids such as fumaric acid, maleic acid, itaconic acid and trans-aconic acid are copolymerized with polyester, and then multiple bonds in the resin may be crosslinked with one another or other vinyl compounds may be crosslinked therewith. In the present exemplary embodiment, the crosslinking agents may be used alone or two or more thereof may be used in combination.

The method of crosslinking by the crosslinking agent may be a method of crosslinking by polymerizing the polymerizable monomer together with the crosslinking agent to crosslink the monomer or a method in which after the binder resin is polymerized while unsaturated portions are allowed to remain in the binder resin, or after the toner is prepared, the unsaturated portions are crosslinked by a crosslinking reaction.

When the binder resin is a polyester resin, the polymerizable monomer may be polymerized by condensation polymerization. As the catalyst for condensation polymerization, a known catalyst may be used, and specific examples thereof may include titanium tetrabutoxide, dibutyltin oxide, germanium dioxide, antimony trioxide, tin acetate, zinc acetate and tin disulfide. When the binder resin is a vinyl-based resin, the polymerizable monomer may be polymerized by radical polymerization.

The radical polymerization initiator is not particularly limited as long as it is capable of emulsion polymerization. Specific examples thereof may include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, peroxy carbonate, diisopropyl tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, and tert-butyl perN-(3-toluoyl)carbamate, azo compounds such as 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenyl azodiphenyl methane, phenyl azotriphenyl methane, 4-nitrophenyl azotriphenyl methane, 1,1'-azobis-1,2-diphenyl ethane and poly(bisphenol A-4,4'-azobis-4-cyanopentanoate), and poly(tetraethyleneglycol-2,2'-azobisisobutyrate), and 1,4-bis(pentaethylene)-2-tetrazene, and 1,4-dimethyloxycarbonyl-1,4-diphenyl-2-tetrazene. These polymerization initiators may also be used as initiators for the crosslinking reaction.

The binder resin has been described by referring mainly to the crystalline polyester resin and the amorphous polyester resin, but besides them, it is possible to use styrenes such as styrene, parachlorostyrene and α-methyl styrene; acrylic monomers such as methyl acrylate, ethyl acrylate, n-propyl acrylate, butyl acrylate, lauryl acrylate and 2-ethylhexyl acrylate; methacrylic monomers such as methyl methacrylate, ethyl methacrylate, n-propyl methacrylate, lauryl methacrylate and 2-ethylhexyl methacrylate; ethylenically unsaturated monomers such as acrylic acid, methacrylic acid and sodium styrenesulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; homopolymers of olefinic monomers such as ethylene, propylene and butadiene, copolymers including a combination of two or more of these monomers, or mixtures thereof; non-vinyl condensed resins such as epoxy resin, polyester resin, polyurethane resin, polyamide resin, cellulose resin and polyether resin, or mixtures thereof with the vinyl-based resin, and graft polymers obtained by polymerizing the vinyl monomers in the presence of these resins.

In a case where the toner of the present exemplary embodiment is prepared by an emulsion polymerization aggregation method as described below, the resin is prepared as a resin particle dispersion liquid. The resin particle dispersion liquid is easily obtained by an emulsion polymerization method or a polymerization method in a heterogeneous dispersion system similar to the emulsion polymerization method. The resin particle dispersion liquid may be obtained optionally by a method such as a method which includes adding a polymer uniformly polymerized in advance by solution polymerization or bulk polymerization, together with a stabilizer, to a solvent in which the polymer is not dissolved, and then mechanically mixing and dispersing it.

For example, when a vinyl-based monomer is used, a resin particle dispersion liquid may be prepared by an emulsion polymerization method or a seed polymerization method using an ionic surfactant or the like, preferably a combination of an ionic surfactant and a nonionic surfactant.

Examples of the surfactant used herein may include, but are not particularly limited to, anionic surfactants based on sulfuric ester salt, sulfonate, phosphate ester and soap; cationic surfactants based on amines and quaternary ammonium salts; nonionic surfactants based polyethylene glycol, alkyl phenol/ethylene oxide adducts, alkyl alcohol/ethylene oxide adducts and polyhydric alcohols, and various graft polymers.

When the resin particle dispersion liquid is prepared by emulsion polymerization, unsaturated acid, for example, acrylic acid, methacrylic acid, maleic acid or styrenesulfonic acid is particularly preferably used as a part of the monomer component so that a protective colloidal layer may be formed on the surfaces of particles to perform soap-free polymerization.

The volume-average particle diameter of the resin particles is preferably 1 μm or less, and more preferably ranges from 0.01 μm to 1 μm. Also, the average particle diameter of the resin particles is measured by a laser diffraction particle size distribution measuring device (manufactured by Shimadzu Corporation, SALD2000A).

—Release Agent—

Examples of the release agent used in the present exemplary embodiment may include low-molecular polyolefins such as polyethylene, polypropylene and polybutene; fatty acid amides such as silicones, oleic acid amide, erucic acid amide, ricinoleic acid amide and stearic acid amide; vegetable wax such as carnauba wax, rice wax, candelila wax, haze wax and jojoba oil; animal wax such as beeswax; mineral or petroleum wax such as montan wax, ozokerite, ceresin, paraffin wax, microcrystalline wax and Fischer Tropsch wax, and modified products thereof.

When the toner is prepared by the emulsion polymerization aggregation method, the release agent may be dispersed in water together with an ionic surfactant, or a polymeric electrolyte such as a polymeric acid or a polymeric base, and heated to the melting temperature or more, and then may be formed into fine particles by a homogenizer capable of giving strong shearing force or a pressure discharging dispersing machine, and used as a release agent dispersion liquid containing release agent particles having an average particle diameter of 1 μm or less.

To prepare the toner, these release agent particles together with the other resin particle components may be added to a mixed solvent all at once or several times in divided portions.

The amount of the release agent to be added preferably ranges from 0.5% to 50% by mass with respect to the total toner particles. The amount more preferably ranges from 1% to 30% by mass and further more preferably ranges from 5% to 15% by mass.

The average dispersion diameter of the release agent dispersed and contained in the toner of the present exemplary embodiment preferably ranges from 0.3 to 0.8 μm, and more preferably ranges from 0.4 to 0.8 μm.

The standard deviation of the dispersion diameter of the release agent is preferably 0.05 or less, and more preferably 0.04 or less.

The average dispersion diameter of the release agent dispersed and contained in the toner is determined by analyzing a TEM (transmission electron microscope) photograph with an image analyzer (Luzex image analyzer, manufactured by Nireko Co., Ltd.) and calculating the mean dispersion diameter (=(long diameter+short diameter)/2) of the release agent in 100 toner particles, and on the basis of the individual dispersion diameters obtained herein, the standard deviation is determined.

The degree of exposure of the release agent to the toner surface preferably ranges from 5 atom % to 12 atom %, and more preferably from 6 atom % to 11 atom %.

The degree of exposure is determined by XPS (X-ray photoelectron spectroscopy) measurement. As the XPS measuring instrument, JPS-900MX manufactured by JEOL is used, and the measurement is performed at an accelerating voltage of 10 kV and an emission current of 30 mA by using MgKα ray as an X-ray source. By a method of peak separation of C1S spectrum, the amount of the release agent on the toner surface is quantified. In the peak separation method, the measured C1S spectrum is separated into respective components by curve fitting with the method of least squares. As spectra of the components on which the separation is based, C1S spectra obtained by measuring each of the release agent, the binder resin and the crystalline resin used in preparing the toner are used.

—Coloring Agent—

The coloring agent used in the present exemplary embodiment may include various pigments such as carbon black, chrome yellow, hanza yellow, benzidine yellow, threne yellow, quinoline yellow, permanent orange GTR, pyrazolone orange, vulcan orange, Watchung red, permanent red, brilliant carmine 3B, brilliant carmine 6B, DuPont oil red, pyrazolone red, lithol red, rhodamine B lake, lake red C, rose Bengal, aniline blue, ultramarine blue, chalco oil blue, methylene blue chloride, phthalocyanine blue, phthalocyanine green and malachite green oxalate, various dyes based on acridine, xanthene, azo, benzoquinone, azine, anthraquinone, thioindigo, dioxazine, thiazine, azomethine, indigo, phthalocyanine, aniline black, polymethine, triphenyl methane, diphenyl methane and thiazole, and a mixture of two or more thereof.

When the toner is prepared by the emulsion polymerization aggregation method, these coloring agents are dispersed in a solvent and used as a coloring agent dispersion liquid. Here, the volume-average particle diameter of the coloring agent particles is preferably 0.8 μm or less, and more preferably ranges from 0.05 μm to 0.5 μm.

The existence ratio of the number of coarse particles having a volume-average particle diameter of 0.8 μm or more in the coloring agent dispersion liquid is preferably less than 10% and preferably substantially 0%. The ratio of the number of nano particles having an average particle diameter of 0.05 μm or less in the coloring agent dispersion liquid is preferably 5% or less.

The volume-average particle diameter of the coloring agent particles is also measured by a laser diffraction particle size distribution measuring device (manufactured by Shimadzu Corporation, SALD2000A). The amount of the coloring agent to be added is preferably set in a range of from 1% to 20% by mass with respect to the total toner particles.

As a method of dispersing the coloring agent in a solvent, any method such as a method using a rotating shearing homogenizer or a ball mill, sand mill or DYNO-mill having media may be used without limitation.

The coloring agent to be used may be surface-modified with rosin, polymer etc. The surface-modified coloring agent is advantageous in that it is stabilized in the coloring agent dispersion liquid, and when the coloring agent is dispersed to a desired average particle diameter in the coloring agent dispersion liquid and mixed with the resin particle dispersion liquid, the coloring agent particles are not aggregated with one another in the aggregation process and may be maintained in an excellent dispersed state.

The polymer used in surface treatment of the coloring agent may include an acrylonitrile polymer, a methyl methacrylate polymer etc.

As the conditions for surface modification, it is generally possible to use a polymerization method of polymerizing a monomer in the presence of the coloring agent (pigment) or a phase separation method which includes dispersing the coloring agent (pigment) in a polymer solution and lowering the solubility of the polymer to precipitate it on the surface of the coloring agent (pigment).

—Other Additives—

When the toner of the present exemplary embodiment is used as a magnetic toner, magnetic powder is contained therein, and examples of the magnetic powder used herein may include metals such as ferrite, magnetite, reduced iron, cobalt, nickel and manganese, alloys thereof and compounds containing the metals. Various kinds of ordinarily used charge controlling agents such as quaternary ammonium salts, Nigrosine compounds and triphenyl methane pigments may also be added.

In the toner of the present exemplary embodiment, an inorganic particle may also be contained. From the viewpoint of durability, it is more preferable that an inorganic particle having a median particle diameter of 5 nm to 30 nm and an inorganic particle having a median particle diameter of 30 nm to 100 nm are contained in the range of 0.5% to 10% by mass with respect to the toner.

Examples of the inorganic particle may include silica, hydrophobized silica, titanium oxide, alumina, calcium carbonate, magnesium carbonate, tricalcium phosphate, colloidal silica, cation surface-treated colloidal silica and anion surface-treated colloidal silica. These inorganic particles may be dispersed in advance in the presence of an ionic surfactant by a sonicator, but colloidal silica which does not require this dispersion treatment is more preferably used.

In the toner of the present exemplary embodiment, a known external additive may be externally added. As the external additive, inorganic particles such as silica, alumina, titania, calcium carbonate, magnesium carbonate and tricalcium phosphate may be used. For example, as a flowability auxiliary agent or a cleaning auxiliary agent, inorganic particles such as silica, alumina, titania and calcium carbonate and resin particles such as vinyl-based resin, polyester and silicone may be used. The method of adding the external additive is not particularly limited, and the external additive in a dried state may be added onto the surfaces of the toner particles with shearing force.

Hereinafter, the preparation of the toner of the present exemplary embodiment will be described.

The toner of the present exemplary embodiment may be produced through a conventional toner preparation method, but is preferably prepared by a so-called wet process, that is, through a process of granulating coloring particles containing a binder resin and a coloring agent in water, an organic solvent or a mixed solvent thereof, and a process of washing and drying the coloring particles so as to control the above described composition of elements on the surface of the toner particles.

Examples of such a wet process may include, but are not limited to, a suspension polymerization method that involves suspending a coloring agent, a release agent and other components, together with a polymerizable monomer that forms a binder resin such as an amorphous resin, to polymerize the polymerizable monomer, a solution suspension method that involves dissolving the above toner constituent materials such as a compound having an ionic dissociation group, a binder resin, a coloring agent, and a release agent in an organic solvent, dispersing the mixture in a suspended state in an aqueous solvent, and then removing the organic solvent, and an emulsion polymerization aggregation method that involves preparing a binder resin component such as an amorphous resin by emulsion polymerization to hetero-aggregate them with a dispersion liquid of a pigment, a release agent etc. and then fusing and coalescing them. Among these methods, the emulsion polymerization aggregation method is most suitable because of excellent toner particle diameter regulation, narrow particle size distribution, shape regulation, narrow shape distribution, internal dispersion regulation, etc.

When the emulsion polymerization aggregation method is used, the toner of the present exemplary embodiment may be prepared at least through an aggregation process of forming aggregated particles in a raw material dispersion liquid including a mixture of a resin particle dispersion liquid having a binder resin such as an amorphous resin or a crystalline resin dispersed therein, a coloring agent dispersion liquid having a coloring agent dispersed therein and a release agent dispersion liquid having a release agent dispersed therein, and a coalescing process of fusing the aggregated particles by heating the raw material dispersion liquid having the aggregated particles formed therein, to a temperature not lower than the glass transition temperature of the binder resin (or the melting temperature of the crystalline resin). Other dispersion liquids such as an inorganic particle dispersion liquid may be added to the raw material dispersion liquid. Especially, when a dispersion liquid of inorganic particles with a hydrophobized surface is added, the dispersibility of the release agent, and the crystalline resin within the toner may be controlled according to hydrophobicity.

Hereinafter, the method of preparing the toner of the present exemplary embodiment will be described in more detail by reference to the emulsion polymerization aggregation method as a specific example.

When the toner of the present exemplary embodiment is prepared by the emulsion polymerization aggregation method, the toner is produced at least through an aggregation process and a coalescing process, and the method may further include an adhesion process of forming an aggregated particle having a core/shell structure in which resin particles are adhered to the surface of an aggregated particle (core particle) formed through the aggregation process.

—Aggregation Process—

In the aggregation process, aggregated particles are formed in a raw material dispersion liquid including a mixture of a resin particle dispersion liquid having a binder resin such as an amorphous resin or a crystalline resin dispersed therein (respective different dispersion liquids of the amorphous resin and the crystalline resin may be prepared), a coloring agent dispersion liquid having a coloring agent dispersed therein and a release agent dispersion liquid having a release agent dispersed therein.

Specifically, a raw material dispersion liquid obtained by mixing the respective dispersion liquids is heated to aggregate particles in the raw material dispersion liquid, thereby forming aggregated particles. The heating is carried out at a temperature lower than the glass transition temperature of the amorphous resin. The temperature preferably ranges from 5° C. to 25° C. lower.

Formation of aggregated particles is carried out by adding an aggregating agent at room temperature (23° C.) under stirring in a rotating shearing homogenizer and then acidifying pH of the raw material dispersion liquid.

As the aggregating agent used in the aggregation process, a surfactant having reverse polarity to that of the surfactant used as a dispersant to be added to the raw material dispersion liquid, that is, a divalent or more metal complex in addition to an inorganic metal salt, may be suitably used. Particularly a metal complex is preferably used because the amount of the surfactant to be used may be reduced and charging properties may be improved.

Examples of the inorganic metal salt may include metal salts such as calcium chloride, calcium nitrate, barium chloride, magnesium chloride, zinc chloride, aluminum chloride and aluminum sulfate, and inorganic metal salt polymers such as poly aluminum chloride, poly aluminum hydroxide and poly calcium sulfide. Among them, the aluminum salts and polymers thereof are particularly preferable. In order to attain a sharper particle size distribution, the valence of the inorganic metal salt is more preferably divalent than monovalent, trivalent than divalent, or tetravalent than trivalent, and given the same valence, an inorganic metal salt polymer of polymerization type is more suitable.

In the present exemplary embodiment, particularly, in order to control the existence ratio of the group IIA elements, group IIIB elements and group IVB elements (except for carbon), in the aggregation process, aggregation is preferably performed with addition of the inorganic metal salt formed as an inorganic particle dispersion liquid. This effectively acts on the molecular chain end of a binder resin and contributes to formation of a crosslinking structure.

The inorganic particle dispersion liquid is produced in the same manner as that in the above described coloring agent dispersion liquid, and the dispersion average particle diameter of the inorganic particles preferably ranges from 100 nm to 500 nm.

In the aggregation process, the inorganic particle dispersion liquid may be added stepwise, or continuously added. Such a method is effective in achieving a uniform existence ratio from the toner surface to the inside. It is particularly preferable that in a case of stepwise addition, the dispersion liquid is added in 3 or more stages, and in a case of continuous addition, the dispersion liquid is added at a low rate of 0.1 g/m or less.

The amount of the inorganic particle dispersion liquid to be added varies according to the kind of a required metal or the extent of crosslinking structure formation, but ranges from 0.5 parts by mass to 10 parts by mass with respect to 100 parts by mass of the binder resin component, and more preferably from 1 part by mass to 5 parts by mass.

Subsequently to the aggregation process, the adhesion process may be performed. In the adhesion process, on the surface of the aggregated particles formed through the aggregation process, the resin particles are adhered so as to form a coating layer. As a result, a toner that has a so-called core-shell structure having a core layer and a shell layer coated thereon is obtained.

The coating layer may be formed usually by additionally adding a dispersion liquid containing amorphous resin particles to a dispersion liquid having aggregated particles (core particles) formed in the aggregation process. The amorphous resin used in the adhesion process may be identical with, or different from, the one used in the aggregation process.

The adhesion process is generally used in preparing a toner having a core/shell structure in which together with the release agent, the crystalline resin as a binder resin is contained as a main component, and the major object is to suppress the exposure of the release agent or the crystalline resin contained in the core layer, to the toner surface, and to compensate for the strength of toner particles.

—Coalescing Process—

In the coalescing process carried out subsequently to the aggregation process, or the aggregation process and the adhesion process, a suspension liquid containing aggregated particles formed through these processes is adjusted in a required range of pH, thereby terminating progress of aggregation and then heated, whereby fusing the aggregated particles.

Here, according to an aim of a pH value, especially, the existence ratio of group IA elements (except for hydrogen) may be controlled in a preferred range.

Adjustment of pH is performed by addition of acid or alkali. The acid is not particularly limited, but an aqueous solution of from 0.1% to 50% of an inorganic acid such as hydrochloric acid, nitric acid, sulfuric acid is preferred. The alkali is not particularly limited, but an aqueous solution of from 0.1% to 50% of hydroxide of an alkali metal such as sodium hydroxide, potassium hydroxide is preferred. In the adjustment of pH, a local change in pH may locally destruct aggregated particle themselves, locally cause excessive aggregation, and cause deterioration in shape distribution. Particularly, according to an increase of scale, the amount of acid or alkali is increased. In general, an input point of acid or alkali is one. When the treatment is performed for the same time, the concentration of acid or alkali at the input point is increased according to an increase of scale.

In order that the existence ratio of Group IA elements (except for hydrogen) is within the range of the present exemplary embodiment, pH preferably ranges from 6.0 to 8.0, and more preferably from 6.5 to 7.5.

After the composition control, aggregated particles are fuse-coalesced by heating. During the heating, each element is reacted with the molecular chain end of the resin to form a crosslinking structure.

In the fusion, heating is performed at a temperature not less than a glass transition temperature of the amorphous resin (or a melting temperature of the crystalline resin) to fuse the aggregated particles.

When heating is carried out for fusion or after fusion is completed, a crosslinking reaction may be carried out by other components. The crosslinking reaction may be also carried out simultaneously with fusion. When the crosslinking reaction is carried out, the crosslinking agent or the polymerization initiator described above is used in preparation of the toner.

The polymerization initiator may be mixed with the dispersion liquid before the stage of preparing the raw material dispersion liquid or may be incorporated into the aggregated particles in the aggregation process. Alternatively, the polymerization initiator may be introduced in the coalescing process or after the coalescing process. When the polymerization initiator is introduced in the aggregation process, adhesion process or coalescing process or after the coalescing process, a solution or emulsion of the polymerization initiator is added to the dispersion liquid. For the purpose of regulating the degree of polymerization, a known crosslinking agent, chain transfer agent, polymerization inhibitor etc. may be added to the polymerization initiator.

—Washing Process, Drying Process, Etc.—

After the process of fuse-coalescing aggregated particles is completed, desired toner particles are obtained by optionally carrying out a washing process, a solid/liquid separation process and a drying process, and in consideration of charging properties, the washing process preferably includes washing by replacement with ion exchanged water. The solid/liquid separation process is not particularly limited, but from the viewpoint of productivity, filtration under suction, filtration under pressure etc. are preferable. The drying process is not particularly limited either, but from the viewpoint of productivity, freeze drying, flash jet drying, fluidizing drying, vibration fluidizing drying etc. are preferably used. Further, various external additives may be added to the toner particles after drying.

Then, physical properties of the toner in the present exemplary embodiment will be described.

In the toner of the present exemplary embodiment, at the measurement frequency of 1 (rad/sec) in the measurement of dynamic viscoelasticity by a sine wave vibration method, a ratio G'(65)/G'(90) of a storage modulus G'(65) to a storage modulus G'(90) at 90° C. ranges from $1\times10$ to $1\times10^3$, and more preferably from $1\times10$ to $5\times10^2$.

In the toner of the present exemplary embodiment, the volume-average particle diameter D50v preferably ranges from 0.1 μm to 10 μm, and further more preferably from 1.0 μm to 4 μm.

The volume-average particle size distribution index GSDv of the toner is preferably 1.28 or less. The number-average particle size distribution index GSDp is preferably 1.30 or less. More preferably, the volume-average particle size distribution index GSDv is 1.25 or less, and the number-average particle size distribution index GSDp is 1.25 or less.

In the present exemplary embodiment, the volume-average particle diameter D50v and various particle size distribution indexes may be measured by using, for example, Multisizer II (manufactured by Beckman Coulter, Inc.) in which ISOTON-II (manufactured by Beckman Coulter, Inc.) is used as an electrolyte. In the measurement, 0.5 mg to 50 mg of a sample for measurement is added to a surfactant as a dispersant, preferably 2 ml of 5% aqueous solution of sodium alkyl benzene sulfonate, and the resultant product is added to 100 ml to 150 ml of electrolyte.

The electrolyte having the sample suspended therein is dispersed for about 1 minute with a sonicator, and the particle size distribution of the particles having a particle diameter in the range of 2.0 μm to 60 μm is measured with an aperture having an aperture diameter of 100 μm by the above Multisizer II. The number of sampled particles is 50000.

A cumulative distribution is drawn with respect to volume and number from the side of small diameter with respect to the particle size range (channel) divided on the basis of the particle size distribution determined as above, and the particle diameter at 16% in accumulation is defined as cumulative volume-average particle diameter D16v and cumulative number-average particle diameter D16p, the particle diameter at 50% in accumulation is defined as cumulative volume-average particle diameter D50v and cumulative number-average particle diameter D50p, and the particle diameter at 84% in accumulation is defined as cumulative volume-average particle diameter D84v and cumulative number-average particle diameter D84p.

Using them, the volume-average particle size distribution index (GSDv) is determined from the formula $(D84v/D16v)^{1/2}$, and the number-average particle size distribution index (GSDp) is obtained from the formula $(D84p/D16p)^{1/2}$.

The average circularity preferably ranges from 0.940 to 0.980, and more preferably from 0.950 to 0.970.

The average circularity of the toner may be measured by a flow-type particle image analyzer FPIA-2000 (manufactured by Toaiyo Denshi Co., Ltd.). In a specific measurement method, 0.1 ml to 0.5 ml of a surfactant, preferably alkyl benzene sulfonate, as a dispersant is added to 100 ml to 150 ml water from which solid impurities are removed in advance, and furthermore a sample for measurement is further added thereto in a range of from 0.1 to 0.5 g. The resultant suspension liquid having the measurement sample dispersed therein is dispersed for 1 to 3 minutes with a sonicator, and the average circularity of the toner is measured at a dispersion liquid density of 3000 to 10,000 toner particles/μl by the above analyzer.

The glass transition temperature Tg of the toner of the present exemplary embodiment is not particularly limited, but is suitably selected in the range of 40 to 70° C.

Tg is, for example, measured using a DSC measuring instrument (differential scanning calorimeter DSC-7, manufactured by Perkin Elmer, Inc.) according to ASTMD3418-8. The melting temperatures of indium and zinc are used in temperature correction in a detection part of the apparatus, and the heat of fuse-melting of indium is used in correction of heat quantity. Using an aluminum pan, with an empty pan set for comparison, a sample is placed on an aluminum pan and measured at a temperature increase rate of 10° C./min.

[Carrier Liquid]

In the liquid developer according to the present exemplary embodiment, as for a carrier liquid, a carrier liquid that has a difference ΔSP(tc) of SP value between the carrier liquid and the toner of from 1.5 to 7.0 is used. Accordingly, a carrier liquid that allows ASP (tc) to be within the above range according to SP value of the toner to be used is selected and used.

The kind of the carrier liquid is not particularly limited as long as it satisfies the above requirement of ΔSP(tc), and examples thereof may include a silicone oil, and polyol.

Examples of the silicon oil may include dimethyl silicone oil (as commercially available products, KF-96, KF-965, KF-968, etc. manufactured by Shinetsu Silicone), methyl hydrogen silicone oil (KF-99, etc. by the same), and methyl phenyl silicone oil (KF-50, KF-54, etc. by the same).

Examples of the polyol may include ethylene glycol (commercially available products manufactured by Wako Pure Chemical Industries, Ltd.), diethylene glycol (by the same), and propylene glycol (by the same).

Moreover, other than the above, an aliphatic-based hydrocarbon solvent such as paraffin oil (as for commercially available products, MORESCO WHITE MT-30P, MORESCO WHITE P40, MORESCO WHITE P70, etc. manufactured by Matsumura Oil Co., Ltd, or ISOPAR L, ISOPAR M, etc. manufactured by EXXON Chemical Co., Ltd), a hydrocarbon-based solvent such as a naphthenic based oil (as for commercially available products, EXXSOL D80, EXXSOL D110, EXXSOL D130, etc. manufactured by EXXON Chemical Co., Ltd., or Naphtesol L, Naphtesol M, or Naphtesol H, New Naphtesol 160, New Naphtesol 200, New Naphtesol 220, or New Naphtesol MS-20 P manufactured by Nippon Petrochemicals Co., Ltd.), an aromatic compound such as toluene, cyclohexane, tetrahydrofuran, acetone, 2-butanol or the like may be used.

For example, from the viewpoint of controlling ΔSP(tc) within the above range, when a toner containing the crystalline polyester is used, it is particularly effective that a silicone oil is combined as for the carrier liquid.

In the image forming apparatus and the image forming method as described below, it is preferable that the difference ΔSP(pt) of SP value between the recording medium and the toner is smaller than the difference ΔSP(pc) of SP value between the recording medium and the carrier liquid.

From the viewpoint of controlling ΔSP(pt) and ΔSP(pc) within the above ranges, it is particularly effective that a toner containing the crystalline polyester, a silicone oil as the carrier liquid and a paper containing cellulose fiber as the recording medium are combined.

The flash temperature of the carrier liquid is preferably 150° C. or more, and further more preferably 200° C. or more.

The flash temperature is measured in accordance with JIS K2265-4 (2007).

The carrier liquid may include various kinds of auxiliary materials, such as a dispersant, an emulsifier, a surfactant, a stabilizer, a wetting agent, a thickener, a foaming agent, an antifoaming agent, a coagulating agent, a gelling agent, an antisetting agent, a charge controlling agent, an antistatic agent, an antioxidant, a softener, a plasticizer, a filler, a reodorant, an adhesion inhibitor, and a release agent.

<Image Forming Apparatus and Image Forming Method>

The image forming apparatus according to the present exemplary embodiment is not particularly limited as long as it uses the above described liquid developer according to the present exemplary embodiment. For example, it may be an image forming apparatus which includes: an electrostatic latent image holding member; a charging device that charges the surface of the electrostatic latent image holding member; a latent image forming device that forms an electrostatic latent image on the surface of the electrostatic latent image holding member; a developing device that stores the liquid developer according to the present exemplary embodiment, and forms a toner image by developing the electrostatic latent image formed on the surface of the electrostatic latent image holding member through the liquid developer; a transfer device that transfers the toner image on a recording medium; and a fixing device that heats and pressurizes the toner image on the recording medium to fix the toner image on the recording medium.

The image forming method according to the present exemplary embodiment is not particularly limited as long as the above described liquid developer according to the present exemplary embodiment is used, and the method may include a step of charging the surface of an electrostatic latent image holding member, a step of forming an electrostatic latent image on the surface of the electrostatic latent image holding member, a step of developing the electrostatic latent image formed on the surface of the electrostatic latent image holding member by the liquid developer according to the present exemplary embodiment to form a toner image; a step of transferring the toner image on a recording medium; and a step of fixing the toner image on the recording medium by heating and pressurizing the toner image on the recording medium.

In the image forming apparatus (image forming method), it is desirable that in a fixing device (fixing step), the fixation is performed in two stages. Specifically, the apparatus and method preferably include a first heating device (first heating step) for heating the toner image in a non-contact manner up to a temperature not less than a temperature (A) at which a storage modulus of the toner in the toner image reaches $1\times10^6$ Pa, and a second heating/pressurizing device (second heating/pressurizing step) for applying pressure while heating at the temperature not less than the temperature (A) after the heating in the first heating device (first heating step).

Also, in the first heating device (first heating step), from the viewpoint of flowablity of the toner, it is preferable that a heating device that heats in a non-contact manner, that is, without contact, may heat at the side of the recording medium formed with the toner image, at the rear surface side of the recording medium (at the side not formed with the toner image), or at both sides.

In the image forming apparatus and image forming method according to the present exemplary embodiment, it is preferable that a difference ΔSP(pt) of SP value between the recording medium and the toner is less than a difference ΔSP(pc) of SP value between the recording medium and the carrier liquid.

As for the recording medium, a conventionally known recording medium may be employed without particular limitation. Examples thereof may include a paper containing a cellulose fiber, a paper (a coated paper) containing various kinds of coat layers formed on a cellulose fiber), a label, a film (film of polyethylene, polyester, polycarbonate, polypropylene, polystyrene, or polyvinyl alcohol).

From the viewpoint of controlling ΔSP(pt) and ΔSP(pc) within the above ranges, it is particularly effective that a toner containing the crystalline polyester, a silicone oil as the carrier liquid and a paper containing cellulose fiber as the recording medium are combined.

Hereinafter, the configurations of the image forming method and the image forming apparatus according to the present exemplary embodiment will be described in detail with reference to drawings.

FIG. 1 is a schematic configuration view illustrating one example of an image forming apparatus according to the present exemplary embodiment.

An image forming apparatus 100 includes a photoreceptor (electrostatic latent image holding member) 10, a charging device 20, an exposure device (latent image forming device) 12, a developing device 14, an intermediate transfer material 16, a cleaner 18, a transfer roller (transfer device) 28, a non-contact heating device (first heating device) 32, heating/pressurizing rolls (second heating/pressurizing device) 34A and 34B.

The photoreceptor 10 has a cylindrical shape, and at the circumference of the photoreceptor 10, the charging device 20, the exposure device 12, the developing device 14, the intermediate transfer material 16, and the cleaner 18 are sequentially provided. At a position of a paper (recording medium) 30 where a toner image 26 transferred to the intermediate transfer material 16 is transferred, the transfer roller 28 is provided. At a lower side than the transfer roller 28 in a progress direction of the paper 30, the non-contact heating device (first heating device) 32 is provided, and at a lower side than the non-contact heating device 32 in a progress direction of the paper 30, a pair of the heating/pressurizing rolls (second heating/pressurizing device) 34A and 34B is provided. In the present exemplary embodiment, the non-contact heating device (first heating device) 32 and the heating/pressurizing rolls (second heating/pressurizing device) 34A and 34B constitute a fixing device.

Hereinafter, an operation of the image forming apparatus 100 will be simply described.

The charging device 20 charges the surface of the photoreceptor 10 at a predetermined electric potential, and the exposure device 12 exposes the charged surface based on an image signal by, for example, laser beam to form an electrostatic latent image.

The developing device 14 includes a developing roller 14*a* and a developer container 14*b*. The developing roller 14*a* is provided in such a manner that its part is immersed in a liquid developer 24 received in the developer container 14*b*. In the liquid developer 24, toner particles are dispersed, but the liquid developer 24 may be stirred by a stirring member provided within the developer container 14*b*.

The liquid developer 24 supplied to the developing roller 14*a* is conveyed to the photoreceptor 10 in an amount limited to a supply amount determined by a control member, and is supplied to the electrostatic latent image at a position where the developing roller 14*a* faces (or comes in contact with) the photoreceptor 10. Thus, the electrostatic latent image is developed and formed into the toner image 26.

The developed toner image 26 is conveyed to the photoreceptor 10 that rotates in the arrow B direction in the drawing, and transferred on the paper (recording medium) 30. In the present exemplary embodiment, before transferred on the paper 30, the toner image is transferred on the intermediate transfer material 16. Here, the photoreceptor 10 and the intermediate transfer material 16 may have different peripheral speeds.

Then, the toner image conveyed in the arrow C direction by the intermediate transfer material 16 is transferred on the paper 30 at a position in contact with the transfer roller 28.

At a lower side than the transfer roller 28 in a progress direction of the paper 30, the non-contact heating device (first heating device) 32 is provided. The non-contact heating device 32 is a plate-shaped heating device, and within the plate body with a metal surface, a heater is provided. At a position of the non-contact heating device 32, the toner image is heated to a temperature not less than a temperature (A) at which a storage modulus of the toner reaches $1\times10^6$ Pa.

As the heater used in the heating device 32, a halogen heater or a hot air drier may be used in a case where the toner image is heated in a non-contact manner at the side of the toner image to be heated, or a heating plate or a heating roll which comes in contact with the rear surface of the toner image may be used in a case where the toner image is heated from the rear surface (that is, the recording medium side) of the toner image to be heated.

The heating temperature of the non-contact heating device 32 is preferably 90° C. or more, and more preferably ranges from 100° C. to 125° C. The heating time is determined according to the progress direction length of the non-contact heating device 32 on the paper 30 and the process speed.

At a lower side than the non-contact heating device (first heating device) 32 in a progress direction of the paper 30, the heating/pressurizing rolls (second heating/pressurizing device) 34A and 34B are provided. The toner image heated at the non-contact heating device 32 is further heated and pressurized by the heating/pressurizing rolls 34A and 34B at a temperature not less than the temperature A to be fixed on the paper 30.

The heating/pressurizing rolls 34A and 34B are opposed to form a nip across the paper 30. The heating/pressurizing rolls 34A and 34B include an elastic rubber layer and a release layer for toner release which are formed on a metal roll, into which the paper 30 is inserted by a pressurizing mechanism (not illustrated) so that a predetermined pressure and a nip width are obtained. At least one side of the heating/pressurizing rolls 34A and 34B, a heater is provided, but heaters may be provided at both sides of the heating/pressurizing rolls 34A and 34B.

The heating temperature at the heating/pressurizing rolls (second heating/pressurizing device) 34A and 34B preferably ranges from 120° C. to 150° C., and further preferably from 130° C. to 140° C. The pressure to be applied preferably ranges from 1.5 kg/cm$^2$ to 5 kg/cm$^2$, and more preferably from 2 kg/cm$^2$ to 3.5 kg/cm$^2$.

At the position of the heating/pressurizing rolls 34A and 34B, the toner image is fixed on the paper 30 to form a fixed image 29, and then the paper 30 is conveyed to a discharge part (not illustrated).

On the other hand, at the photoreceptor 10 which has transferred the toner image 26 on the intermediate transfer material 16, transfer residual toner particles are carried to a position in contact with the cleaner 18, and collected by the cleaner 18. When the transfer efficiency is substantially 100%, and generation of a residual toner is reduced, the cleaner 18 may not be provided.

The image forming apparatus 100 may further include a charge eliminating device (not shown) for performing charge elimination of the surface of the photoreceptor 10 after transfer until the following charging.

All of the charging device 20, the exposure device 12, the developing device 14, the intermediate transfer material 16, the transfer roller 28, the cleaner 18, the non-contact heating device (first heating device) 32, and the heating/pressurizing rolls (second heating/pressurizing device) 34A and 34B provided in the image forming apparatus 100 are operated in synchronization with the rotation speed of the photoreceptor 10.

Hereinafter, another example of an image forming apparatus according to the present exemplary embodiment will be described with a drawing.

Figure 2:
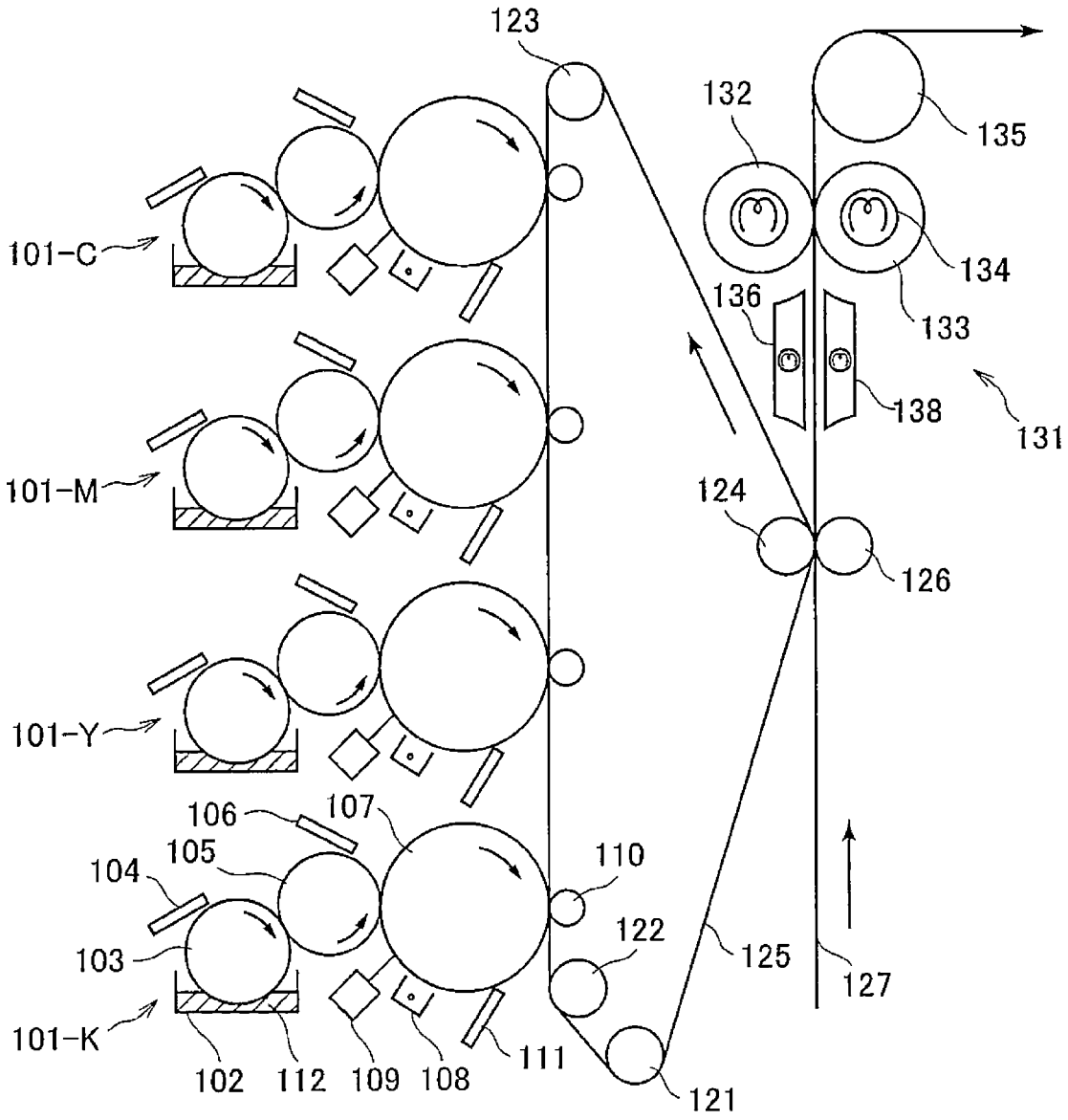
FIG. 2 is a schematic configuration view illustrating another example of an image forming apparatus according to the present exemplary embodiment.

FIG. 2 is a schematic configuration view illustrating another example of an image forming apparatus according to the present exemplary embodiment, in which a tandem type of an image forming apparatus is illustrated.

The image forming apparatus illustrated in FIG. 2 includes a cyan developing unit 101-C, a magenta developing unit 101-M, a yellow developing unit 101-Y, and a black developing unit 101-K. Each developing unit includes a developer tank 102, a developer supply roll 103, a supply amount control unit 104, a developing roll (developing device) 105, a developing roll cleaner 106, a photoreceptor (electrostatic latent image holding member) 107, a charging device 108, an exposure device (latent image forming device) 109, a primary transfer device 110, and a photoreceptor cleaner 111. Further, an intermediate transfer material 125 is provided to come in contact with the photoreceptor 107 of each of the four developing units, and secondary transfer devices 124 and 126 are provided to transfer a toner image transferred on the intermediate transfer material 125 to a paper (recording medium) 127. At a lower side than the secondary transfer devices 124 and 126 in a progress direction of the paper 127, a fixing unit (fixing device) 131 is provided, and at a lower side than the fixing unit 131, a discharge roll 135 is provided.

In the fixing unit 131, non-contact heating devices (first heating device) 136 and 138, a heating roll 132 and a pressurizing roll 133 (second heating/pressurizing device) are sequentially provided from the upper side in a progress direction of the paper 127.

A liquid developer 112 is maintained in a predetermined amount in the developer tank 102 by a developer circulating unit (not illustrated), and is conveyed from the developer tank 102 to the developing roll 105 by the developer supply roll 103. The developer supply roll 103 may be attached with the developer by an electrostatic force through charging of the surface, or may have a groove or a concave therein and conveyed to pump out the liquid, and the supply amount control unit 104 regulates the amount to be conveyed to a predetermined value. The photoreceptor 107 is charged by the charging device 108 so that its surface may have a predetermined electrostatic bias, and on the surface, an electrostatic latent image is formed by light beam from the exposure device 109 based on an image signal transmitted from a host computer (not shown). The liquid developer on the developing roll 105 is transferred on the photoreceptor 107 according to the electrostatic latent image to form a toner image, and an unnecessary developer is returned to the developer tank 102 by the developing roll cleaner 106 and the developer circulating unit (not illustrated).

The toner image formed on the photoreceptor 107 is transferred on the intermediate transfer material 125 by the primary transfer device 110. Also, the intermediate transfer material 125 is supported by a driving roll 121, support rolls 122 and 123, and the secondary transfer device 124, and the driving roll 121 drives the intermediate transfer material 125 in the arrow direction by a driving motor and a power transmission mechanism (not illustrated), and gives a predetermined tension to the intermediate transfer material 125 by a spring mechanism (not illustrated). The primary transfer devices 110 sequentially transfer cyan•magenta•yellow•black toner images on the intermediate transfer material 125 by electrostatic force and pressure. The primary transfer devices 110 of respective colors may have different set electric potentials. The liquid developer remaining on the photoreceptor 107 is removed by the photoreceptor cleaner 111.

The toner image transferred on the intermediate transfer material 125 is transferred on the paper (recording medium) 127 by the secondary transfer devices 124 and 126 and fixed by the fixing unit 131.

The fixing unit 131 includes the first heating device and the second heating/pressurizing device sequentially from the upper side in a progress direction of the paper 127, and includes the non-contact heating devices 136 and 138 as the first heating device. Each of the non-contact heating devices 136 and 138 is a plate-shaped heating device, and within the plate body with a metal surface, a heater is provided. At a position of the non-contact heating devices 136 and 138, the toner image is heated to a temperature not less than a temperature (A) at which a storage modulus of the toner reaches $1\times10^6$ Pa.

The heating temperature of the non-contact heating devices 136 and 138 is preferably 90° C. or more, and more preferably ranges from 100° C. to 125° C. The heating time is determined according to the progress direction length of the non-contact heating devices 136 and 138 on the paper 127 and the process speed.

The fixing unit 131 is provided with a pair of the heating roll 132 and the pressurizing roll 133, as the second heating/pressurizing device, and a heater 134 provided within each roll. The toner image heated at the non-contact heating devices 136 and 138 is further heated and pressurized by the pair of the heating roll 132 and the pressurizing roll 133 at a temperature not less than the temperature A to be fixed on the paper 127.

The heating roll 132 and the pressurizing roll 133 are opposed to form a nip across the paper 127. Each of the heating roll 132 and the pressurizing roll 133 includes an elastic rubber layer and a release layer for toner release which are formed on a metal roll, into which the paper 127 is inserted by a pressurizing mechanism (not illustrated) so that a predetermined pressure and a nip width are obtained. At both sides of the heating roll 132 and the pressurizing roll 133, heaters are provided, but the heater may be provided at least one side of the heating roll 132 and the pressurizing roll 133.

The heating temperature at the heating roll 132 and the pressurizing roll 133 preferably ranges from 120° C. to 150° C., and further preferably from 130° C. to 140° C. The pressure to be applied preferably ranges from 1.5 kg/cm$^2$ to 5 kg/cm$^2$, and more preferably from 2 kg/cm$^2$ to 3.5 kg/cm$^2$.

At a lower side of the fixing unit 131, the discharge roll 135 is provided, and the paper 127 on which the toner image is fixed is conveyed by the discharge roll 135 to a discharge part (not illustrated).

As the first heating device, a plate-shaped heating device illustrated in FIG. 1 within which a heater is provided heats at the rear surface of the recording medium (at the reverse side of the toner image), and a plate-shaped heating device illustrated in FIG. 2 within which a heater is provided heats at both front/rear sides of the recording medium, in a non-contact manner. However, the type of the first heating device is not limited thereto, but may be one capable of heating the front side (toner image side) of the recording medium in a non-contact manner. For example, by a plate-shaped heating device within which a heater is provided, heating may be performed only at the front side (toner image side) of the recording medium. Also, a blower for blowing hot air or an irradiation device for irradiating infrared light may be applied.

As the second heating/pressurizing device, FIG. 1 illustrates a pair of the heating/pressurizing rolls 34A and 34B, and FIG. 2 illustrates a pair of the heating roll 132 and the pressurizing roll 133, but the present invention is not limited thereto. For example, the device may be a device including a heating/pressurizing roll combined with a pressurizing belt, and a device including a pressurizing roll combined with a heating/pressurizing belt.

In the image forming apparatuses illustrated in FIGS. 1 and 2, the liquid developer may be supplied to the developer container 14*b* or the developer tank 102 from a liquid developer cartridge (not illustrated) detachable from the image forming apparatus.

In FIG. 1, the developing device 14 may employ a process cartridge type so that it is detachable from the image forming apparatus 100, and in FIG. 2, the developer tank 102, the developer supply roll 103, the supply amount control unit 104, the developing roll 105, and the developing roll cleaner 106 may be integrated, and may employ a process cartridge type so that they are detachable from the image forming apparatus.

EXAMPLES

Hereinafter, the present invention will be described in more detail with reference to Examples, but is not limited to the Examples below. Hereinafter, "part" and "%" are by mass as long as there is no particular limitation.

<Measurement Method of Various Characteristics>

First, measurement methods of physical properties of a toner used in Examples and Comparative Examples will be described.

(Molecular Weight of Resin)

The molecular weight of a resin is measured under the following conditions. "HLC-8120GPC, SC-8020 (manufactured by Tosoh Corporation)" as GPC, two columns "TSKgel, Super HM-H (6.0 mm ID×15 cm, manufactured by Tosoh Corporation)" and THF (tetrahydrofuran) as an eluent are used. The experiment conditions are as follows: the sample concentration is 0.5%, the flow rate is 0.6 ml/min., the volume of a sample injected is 10 μl, the measurement temperature is 40° C., and an IR (Refractive Index) detector is used in the experiment. A calibration curve is prepared from 10 samples of "polystyrene standard sample TSK standard" manufactured by Tosoh Corporation: "A-500", "F-1", "F-10", "F-80", "F-380", "A-2500", "F-4", "F-40", "F-128", and "F-700".

(Volume-Average Particle Diameter of Toner, Resin Particles, and Coloring Agent Particles)

The volume-average particle diameters of a toner, resin particles, and coloring agent particles are measured by the following method.

When the diameter of particles to be measured is 2 μm or more, as a measurement instrument, Coulter Multisizer II (manufactured by Beckman Coulter, Inc.) is used, and as an electrolyte, ISOTON-II (manufactured by Beckman Coulter, Inc) is used to measure the particle diameter.

In the measurement method, 0.5 mg to 50 mg of a measurement sample is added in 2 mL of a 5% aqueous solution of a surfactant as a dispersant, preferably sodium alkylbenzenesulfonate. The mixture is added in 100 ml to 150 ml of the foregoing electrolytic solution. The electrolytic solution having a sample suspended therein is dispersed for one minute using an ultrasonic disperser, and particle size distribution of particles with a particle diameter ranging from 2.0 μm to 60 μm is measured by using an aperture having an aperture diameter of 100 μm by the above Multisizer Type II. The number of particles to be measured is 50,000.

A cumulative distribution is drawn with respect to volume and number from the side of small diameter with respect to the particle size range (channel) divided on the basis of the determined particle size distribution, and the particle diameter at 16% in accumulation with respect to volume is defined as volume-average particle diameter D16v and the cumulative number particle diameter at 16% in accumulation with respect to number is defined as D16p. The particle diameter at 50% in accumulation with respect to volume is defined as volume-average particle diameter D50v and the particle diameter at 50% in accumulation with respect to number is defined as number-average particle diameter D50p, and the particle diameter at 84% in accumulation with respect to volume is defined as volume-average particle diameter D84v and the cumulative number particle diameter at 84% in accumulation with respect to number is defined as D84p. The volume-average particle diameter is D50v.

By using them, the volume-average particle size distribution index (GSDv) is calculated from $(D84v/D16v)^{1/2}$, and the number-average particle size index (GSDp) is calculated from $(D84p/D16p)^{1/2}$. The number-average particle size index (lower GSDp) from the small diameter side is calculated from {(D50p)/(D16p)}.

When the diameter of particles to be measured is less than 2 μm, a laser diffraction particle size distribution measuring device (LA-700: manufactured by Horiba) is used for the measurement. In the measurement, a sample in a dispersion liquid state is adjusted to be 2 g in solid and ion-exchange water is added thereto up to 40 ml. The resultant is introduced into a cell up to a proper concentration, is held for 2 minutes, and is then measured when the concentration of the cell has been stabilized. The obtained volume-average particle diameter of each channel is accumulated from the smallest side, and the value at 50% in accumulation is used as the volume-average particle diameter.

(Glass Transition Temperature and Melting Temperature of Resin)

The glass transition temperature (Tg) and the melting temperature (Tm) are obtained at each maximum peak measured in accordance with ASTMD3418-8. The glass transition temperature is set as a temperature at an intersection point of extension lines of a rising line and a base line at an endothermic portion, and the melting temperature is set as a peak temperature of the endothermic peak. In the measurement, a differential scanning calorimeter (DSC-7, manufactured by Perkin Elmer, Inc) is used.

<Preparation of a Toner>

—Preparation of an amorphous polyester resin (1) and an amorphous resin particle dispersion liquid (1a)—

35 parts by mole of polyoxyethylene(2,0)-2,2-bis(4-hydroxyphenyl)propane 65 parts by mole of polyoxypropylene (2,2)-2,2-bis(4-hydroxyphenyl)propane 80 parts by mole of terephthalic acid 15 parts by mole of n-dodecenyl succinic acid 10 parts by mole of tremellitic acid A two-necked flask dried by heating is charged with the above ingredients and dibutyltin oxide in an amount of 0.05 parts by mole with respect to these acid components (number of moles in total of the terephthalic acid, n-dodecenyl succinic acid and trimellitic acid), and after a nitrogen gas is introduced into the container, the mixture is heated in the inert atmosphere and subjected to co-condensation polymerization at 150 to 230° C. for about 12 hours and then gradually depressurized at 210 to 250° C. to synthesize an amorphous polyester resin (1).

By measurement (expressed by polystyrene) of molecular weight by GPC (gel permeation chromatography), the weight-average molecular weight (Mw) of the resultant amorphous polyester resin (1) is measured as 15000, and the number average molecular weight (Mn) is measured as 6800.

When the amorphous polyester resin (1) is measured with a differential scanning calorimeter (DSC), no distinct peak is shown, and a stepwise endothermic change is observed. A glass transition temperature in the center of the stepwise endothermic change is 62° C.

An emulsifying tank in a high-temperature/high pressure emulsifier (Cabitron CD1010, slit 0.4 mm) is charged with 3000 parts of the resultant amorphous polyester resin (1), 10000 parts of ion exchanged water and 90 parts of surfactant, sodium dodecyl benzene sulfonate, and the mixture is molten by heating at 130° C., dispersed at 110° C. at a flow rate of 3 L/m at 10000 rpm for 30 minutes and passed through a cooling tank to recover an amorphous resin particle dispersion liquid (high temperature/high pressure emulsifier (Cabitron CD1010, slit 0.4 mm), and thus, an amorphous resin particle dispersion liquid (1a) is obtained.

In the resin particles contained in the resultant amorphous resin particle dispersion liquid (1a), the volume-average particle diameter D50v is 0.3 μm and the standard deviation is 1.2.

—Preparation of a crystalline polyester resin (2) and a crystalline resin particle dispersion liquid (2a)—

293 parts of 1,4-butanediol (manufactured by Wako Pure Chemical Industries, Ltd)

750 parts of dodecane dicarboxylic acid (manufactured by Wako Pure Chemical Industries, Ltd)

0.3 parts of catalyst (dibutyltin oxide)

A three-necked flask dried by heating is charged with the above ingredients, the air in the container is placed in an inert atmosphere by a nitrogen gas through depressurization, and the mixture is stirred in the under mechanical stirring at 180° C. for 2 hours. Thereafter, the mixture is gradually heated to 230° C. under reduced pressure and stirred for 5 hours, and when the mixture becomes viscous, it is air-cooled to terminate the reaction, whereby a crystalline polyester resin (2) is synthesized.

By measurement (expressed by polystyrene) of molecular weight by GPC (gel permeation chromatography), the weight-average molecular weight (Mw) of the resultant crystalline polyester resin (2) is measured as 18000.

When the melting temperature (Tm) of the crystalline polyester resin (2) is measured with a differential scanning calorimeter (DSC) by the above-mentioned measurement method, a clear peak appears and the temperature of a peak top is 70° C.

A crystalline resin particle dispersion liquid (2a) is prepared under the same conditions as in the resin particle dispersion liquid (1a) except that the crystalline polyester resin (2) is used. The volume-average particle diameter D50v of the particles contained in the resultant dispersion liquid is 0.25 μm and the standard deviation thereof is 1.3.

—Preparation of a Coloring Agent Dispersion Liquid (1)—

25 parts of phthalocyanine pigment (PVFASTBLUE, manufactured by Dainichiseika Color & Chemicals Mfg. Co., Ltd)

2 parts of anionic surfactant (EOGEN RK, manufactured by DAI-ICHI KOGYO SEIYAKU CO., LTD.)

125 parts of ion exchanged water

The above ingredients are mixed, dissolved and dispersed by a homogenizer (ULTRATAX, manufactured by IKA Co., Ltd) to provide a coloring agent dispersion liquid (1).

—Preparation of a Release Agent Particle Dispersion Liquid (1)—

100 parts of Pentaerythritol behenic acid tetraester wax 2 parts of anionic surfactant (NEWLEX R, manufactured by NOF CORPORATION)

300 parts of ion exchanged water

The above ingredients are mixed, dissolved and dispersed by a homogenizer (ULTRATAX, manufactured by IKA Co., Ltd.) and then dispersed by a pressure discharging homogenizer to provide a release agent particle dispersion liquid (1).

—Preparation of an Inorganic Particle Dispersion Liquid (1)—

100 parts of hydrophobic silica (RX 200, manufactured by NIPPON AEROSIL CO., LTD)

2 parts of anionic surfactant (NEWLEX R, manufactured by NOF CORPORATION)

1000 parts of ion exchanged water

The above ingredients are mixed, dissolved and dispersed by a homogenizer (ULTRATAX, manufactured by IKA Co., Ltd.) and then dispersed by an ultrasonic homogenizer (RUS-600 CCVP, manufactured by Nippon Seiki) with 200 passes to provide an inorganic particle dispersion liquid (1).

—Preparation of a Toner (1)—

145 parts of amorphous resin particle dispersion liquid (1a)

30 parts of crystalline resin particle dispersion liquid (2a)

42 parts of coloring agent dispersion liquid (1)

36 parts of release agent particle dispersion liquid (1)

10 parts of inorganic particle dispersion liquid (1)

0.5 parts of aluminum sulfate (manufactured by Wako Pure Chemical Industries, Ltd)

300 parts of ion exchanged water

The above ingredients are placed in a round stainless steel flask, adjusted to pH 2.7, dispersed with a homogenizer (ULTRATAX T50, manufactured by IKA Co., Ltd.) and heated to 45° C. under stirring in a heating oil bath. When the mixture is kept at 48° C. for 120 minutes and then observed through an optical microscope, formation of aggregated particles having an average particle diameter of about 5.6 μm is confirmed.

After this dispersion is further heated under stirring for 30 minutes at 48° C., it is confirmed by observation through an optical microscope that aggregated particles having an average particle diameter of about 6.5 μm is formed. The pH of the aggregated particle dispersion liquid is 3.2. Subsequently, 1 N aqueous solution of sodium hydroxide is slowly added thereto to adjust to pH 8.0, and then the dispersion is heated at 90° C. under stirring for 3 hours. Thereafter, the reaction product is filtered off, washed with ion exchanged water and dried with a vacuum dryer to give toner particle (1).

The volume-average particle diameter D50v of the resultant toner particle (1) is 6.5 μm. 1 part of fumed silica (R972, manufactured by NIPPON AEROSIL CO., LTD.) is mixed with, and externally added to, 100 parts of the toner particles in a Henschel mixer to give a toner (1).

When the storage modulus of the toner (1) is determined by the above descried method, a storage modulus G'(65) at 65° C. is $7\times10^7$ Pa, a storage modulus G'(90) at 90° C. is $3\times10^5$ Pa, and a ratio G'(65)/G'(90) of the storage modulus G'(65) to the storage modulus G'(90) is $2.3\times10^2$.

When the SP value of the toner (1) is determined by the above descried method, the SP value is 9.0.

Preparation of a Liquid Developer

Example I-1

Preparation of a Liquid Developer (A1)

The toner (1) obtained from above is mixed with a dimethyl silicone oil (KF-96-20 cs, manufactured by Shinetsu Silicone) in a glass bottle to provide a liquid developer (A1).

Example I-2

Preparation of a Liquid Developer (A2)

The toner (1) obtained from above is mixed with ethylene glycol (manufactured by Wako Pure Chemical Industries, Ltd) in a glass bottle to provide a liquid developer (A2).

Comparative Example I-1

Preparation of a Comparative Liquid Developer (B1)

The toner (1) obtained from above is mixed with a liquid paraffin oil (MORESCO WHITE P40 manufactured by Matsumura Oil Co., Ltd, flash temperature: 130° C.) in a glass bottle to provide a liquid developer (B1).

In addition, on the liquid developers A1 and A2 and a non-crosslinked liquid developer B1, the dispersibility evaluation is performed using a liquid developer at a concentration of 10%, and the fixability evaluation is performed using a liquid developer at a concentration of 30%.

Comparative Example I-2

Preparation of a Comparative Liquid Developer (B2)

The toner (1) obtained from above is mixed with cyclohexane (manufactured by Wako Pure Chemical Industries, Ltd) in a glass bottle to provide a comparative liquid developer (B2) at a toner concentration of 10%.

Comparative Example I-3

Preparation of a Comparative Liquid Developer (B3)

The toner (1) obtained from above is mixed with toluene (manufactured by Wako Pure Chemical Industries, Ltd) in a glass bottle to provide a comparative liquid developer (B3) at a toner concentration of 10%.

Comparative Example I-4

Preparation of a Comparative Liquid Developer (B4)

The toner (1) obtained from above is mixed with tetrahydrofuran (manufactured by Wako Pure Chemical Industries, Ltd) in a glass bottle to provide a comparative liquid developer (B4) at a toner concentration of 10%.

Comparative Example I-5

Preparation of a Comparative Liquid Developer (B5)

The toner (1) obtained from above is mixed with acetone (manufactured by Wako Pure Chemical Industries, Ltd) in a glass bottle to provide a comparative liquid developer (B5) at a toner concentration of 10%.

Comparative Example I-6

Preparation of a Comparative Liquid Developer (B6)

The toner (1) obtained from above is mixed with water in a glass bottle to provide a comparative liquid developer (B6) at a toner concentration of toner 10%.

In addition, the SP value of each carrier liquid used in the liquid developers and the comparative liquid developers is obtained by the above described method. The obtained SP value, and a difference ΔSP(tc) in SP value between the toner (1) and the corresponding carrier liquid are shown in Table 1 below.

Evaluation Test (I): Evaluation of Toner Dispersibility in Carrier Liquid

On each of the liquid developers and the comparative liquid developers obtained from above, dispersibility of the toner (1) is evaluated with naked eye and enlargement observation according to the following evaluation criteria. This evaluation is performed after the toner and the carrier liquid are mixed and left for 1 hour. The result is noted in Table 1 below.

- dispersed: a state where toner particles are uniformly dispersed at naked eye observation and enlargement observation
- completely molten: a state where toner particles are not observed at naked eye observation and enlargement observation
- aggregated: a state where coarse particles are observed at naked eye observation
- separated: a state where a carrier liquid and toner particles are completely separated at naked eye observation

TABLE 1

| | Example | Comparative Example | | | | | Example | Comparative Example |
|---|---|---|---|---|---|---|---|---|
| | I-1 | I-1 | I-2 | I-3 | I-4 | I-5 | I-2 | I-6 |
| Liquid developer | A1 | B1 | B2 | B3 | B4 | B5 | A2 | B6 |
| Carrier liquid | dimethyl silicone | liquid paraffin | cyclohexane | toluene | tetrahydrofuran | acetone | ethylene glycol | water |
| Carrier liquid, SP value [reference value] | 7.2 | 7.9 | 8.2 | 8.8 | 9.1 | 9.9 | 14.6 | 23.4 |

TABLE 1-continued

| | Example | Comparative Example | | | | | Example | Comparative Example |
|---|---|---|---|---|---|---|---|---|
| | I-1 | I-1 | I-2 | I-3 | I-4 | I-5 | I-2 | I-6 |
| Toner SP value | 9.0 | 9.0 | 9.0 | 9.0 | 9.0 | 9.0 | 9.0 | 9.0 |
| ΔSP(tc) | 1.8 | 1.1 | 0.8 | 0.2 | 0.1 | 0.9 | 5.6 | 12.4 |
| Toner dispersibility | dispersed | dispersed | aggregated | completely molten | completely molten | aggregated | dispersed | separated |

Evaluation Test II: Evaluation of a Carrier Liquid Remaining in a Fixed Image In the following three kinds of carrier liquids, under a condition of abundance of oil, a fixed image of the toner (1) is formed by the method below, and the amount of a residual carrier liquid contained in the fixed image is calculated.

Example II-1

As a carrier liquid, dimethyl silicone oil (manufactured by Shinetsu Silicone, KF-96-20cs, SP value: 7.2, ΔSP(tc):1.8) is used.

By using a barcoater, a liquid developer with a concentration of 30% is coated on a polyethyleneterephthalate film to form a sample film (toner mass (TMA1)=8.7 g/m$^2$). Here, carrier liquid mass (CMA1) is 20.3 g/m$^2$. By using a hot plate, the sample film is fixed by being heated from the rear surface side (the polyethyleneterephthalate film side not coated with the liquid developer) at 80° C. for 3 minutes. The sample film is immersed in KF-96L-2cs as a high volatile solvent for 3 min, and the carrier KF-96-20cs on the fixed image is removed. Then, the sample film is dried under reduced pressure for 2 hours to dry KF-96 L-2cs.

The resultant fixed image is subjected to mass spectrometry to obtain toner mass (TMA2) in the fixed image, carrier liquid mass (CMA2) in the fixed image, and carrier liquid mass (CMA3) outside the fixed image (not contained in the fixed image), and then the residual rate of the carrier liquid in the fixed image is obtained.

Example II-2

As a carrier liquid, ethylene glycol (manufactured by Wako Pure Chemical Industries, Ltd, SP value: 14.6, ΔSP(tc):5.6) is used.

By using a barcoater, a liquid developer with a concentration of 30% is coated on a polyethyleneterephthalate film to form a sample film (toner mass (TMA1)=9.0 g/m$^2$). Here, carrier liquid mass (CMA1) is 20.8 g/m$^2$.

Then, a fixed image is formed in the same manner as in Example II-1, and the resultant fixed image is subjected to mass spectrometry to obtain TMA2, CMA2, CMA3, and the residual rate of the carrier liquid in the fixed image in the same manner as in Example II-1.

Comparative Example II-1

As a carrier liquid, liquid paraffin oil (MORESCO WHITE P40 manufactured by Matsumura Oil Co., Ltd, SP value: 7.9, ΔSP(tc):1.1) is used.

By using a barcoater, a liquid developer with a concentration of 30% is coated on a polyethyleneterephthalate film to form a sample film (toner mass (TMA1)=9.7 g/m$^2$). Here, carrier liquid mass (CMA1) is 22.6 g/m$^2$.

Then, a fixed image is formed in the same manner as in Example II-1, and the resultant fixed image is subjected to mass spectrometry to obtain TMA2, CMA2, CMA3, and the residual rate of the carrier liquid in the fixed image in the same manner as in Example II-1.

The results obtained from above are shown in Table 2 below.

TABLE 2

| | | Example | | Comparative Example |
|---|---|---|---|---|
| | | II-1 | II-2 | II-1 |
| | | Carrier liquid | | |
| | | Dimethyl silicone | Ethylene glycol | Liquid paraffin |
| ΔSP(tc) | | 1.8 | 5.6 | 1.1 |
| Toner mass TMA2 in fixed image | g/m$^2$ | 8.7 | 9.0 | 9.7 |
| Carrier liquid mass CMA3 outside fixed image | | 19.8 | 20.1 | 16.4 |
| Carrier liquid mass CMA2 in fixed image | | 0 | 0 | 3.9 |
| Residual rate of carrier liquid | % | 0% | 0% | 28% |

Figure 3:
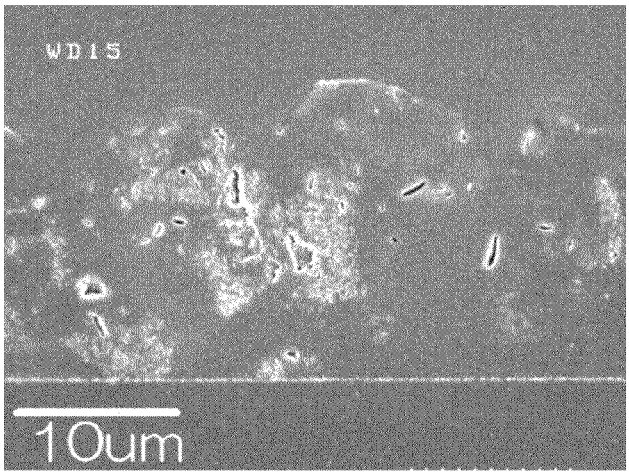
FIG. 3 is a cross-sectional image of a fixed image formed in Example II-1.
Figure 4:
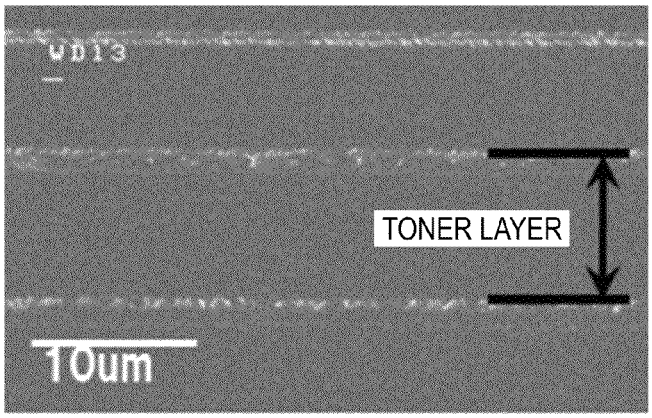
FIG. 4 is a cross-sectional image of a fixed image formed in Example II-2.
Figure 5:
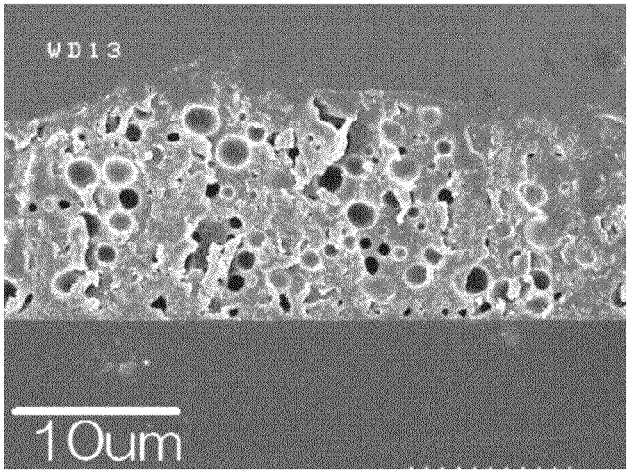
FIG. 5 is a cross-sectional image of a fixed image formed in Comparative Example II-1.

Cross-sectional images in fixed images obtained from Example II-1 (dimethyl silicone oil), Example II-2 (ethylene glycol), and Comparative Example II-1 (liquid paraffin oil) are illustrated in FIGS. 3, 4, and 5, respectively.

As shown in Table 2, it can be found that in Examples having a low affinity with the toner 1, that is, Example II-1 using silicone oil (ΔSP(tc) 1.8) and Example II-2 using ethylene glycol (ΔSP(tc) 5.6), the carrier liquid does not remain in the fixed image (residual rate 0%). Further, from the cross-sectional images as illustrated in FIGS. 3 and 4, it can be seen that melting between toners is efficiently conducted. Meanwhile, it can be found that in Example having a high affinity with the toner (1), that is, Comparative Example II-1 using paraffin oil (ΔSP(tc) 1.1), the carrier liquid remains in the fixed image (residual rate 28%). Further, from the cross-sectional image as illustrated in FIG. 5, due to the residual oil, the melting between toners is insufficient as compared to Example II-1 and Example II-2.

Evaluation Test (III): Evaluation of Fixability in Comparison to Dry Toner

A fixed image fixed by using a liquid developer (carrier liquid: dimethyl silicone oil), and a fixed image fixed by using the toner (1) as a dry toner are formed, and respective cross-sectional images are compared to each other.

Example III-1

First, in the preparation of the liquid developer (A1), by adjusting a ratio of the toner (1) and the dimethyl silicone oil, a liquid developer with a toner concentration of 30% is obtained.

Then, an experimental model of an image forming apparatus for liquid development (its fixing device has a configuration where the fixation is performed in two stages, that is, a toner image is heated by a halogen heater in a non-contact manner at a first stage, and is further heated and pressurized by a pair of fixing rolls at a second stage) is prepared, and the liquid developer is filled while FGN85gsm (manufactured by Oji Paper Co., Ltd.) as a recording medium is loaded. When the development is performed, toner mass (TMA) and carrier liquid mass (CMA) are adjusted so that they become 3.5 g/m$^2$, and 3.5 g/m$^2$ respectively at the time of transfer of the liquid developer on the recording medium. After the process speed is set as 80 m/min, and the fixing conditions are set as non-contact heating at 120° C. at the first stage, and heating/pressuring at 140° C. and 2.7 kg/cm$^2$ at the second stage, a fixed image is formed on the recording medium.

Reference Example III-1

First, a ferrite carrier is prepared. 100 parts of ferrite particles (manufactured by Powder Tech Co., Ltd., average particle diameter: 50 μm), and 2.5 parts of methacrylate resin (manufactured by Mitsubishi Rayon Co., Ltd, weight average molecular weight: 95000) together with 500 parts of toluene are charged in a pressurizing kneader, mixed by stirring at room temperature (23° C.) for 15 minutes, and heated up to 70° C. by mixing under reduced pressure to distill off toluene. The resultant product is cooled and classified by a sieve with a mesh size of 105 μm so as to provide the ferrite carrier (resin-coated carrier).

The ferrite carrier is mixed with the toner (1) to provide a two-component dry developer with a toner concentration of 7% by mass.

Then, as an image forming apparatus for dry development, a digital color press manufactured by Fuji Xerox Co., Ltd. FX700 is prepared, and the dry developer obtained from above is filled while a cut paper of FGN85gsm (manufactured by Oji Paper Co., Ltd.) as a recording medium is loaded. When the development is performed, toner mass is adjusted so that it becomes 3.9 g/m$^2$ at the time of transfer of the toner on the recording medium. After the process speed is set as 18.5 m/min, and the fixing conditions are set as heating/pressuring at 140° C. at a rate of 6.6 m/min, a fixed image is formed on the recording medium.

Figure 6:
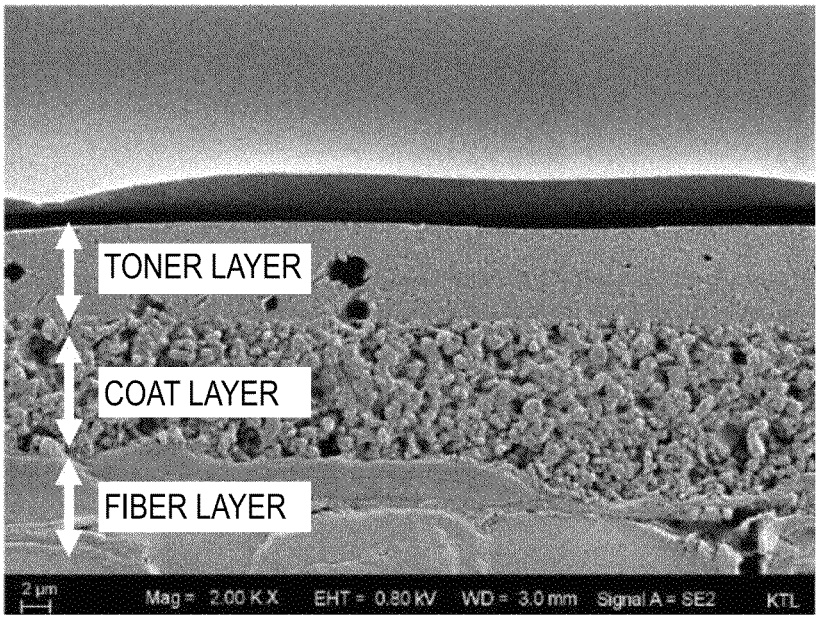
FIG. 6 is a cross-sectional image of a fixed image formed in Example III-1.
Figure 7:
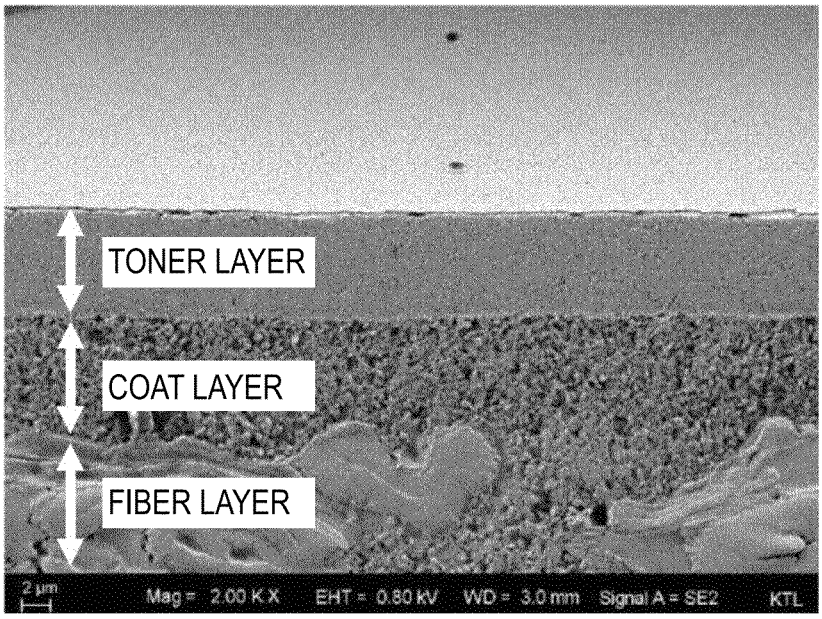
FIG. 7 is a cross-sectional image of a fixed image formed in Reference Example III-1.

Cross-sectional images in fixed images obtained from Example III-1 (liquid development) and Reference Example III-1 (dry development) are illustrated in FIGS. 6 and 7, respectively. When the fixed toner layers of FIGS. 6 and 7 are compared to each other, the fixed image through liquid development of Example III-1 stands comparison with dry development of Reference Example III-1. It can be seen that although both the process speed, and the fixation rate are significantly high, the presence of the carrier liquid has no significant influence on fixability.

Evaluation Test (IV): Evaluation of Image Durability

On each of the fixed images fixed by a liquid developer (carrier liquid: dimethyl silicone oil) and a comparative liquid developer (carrier liquid: paraffin oil), image durability is evaluated by the following method.

Example IV-1

First, in the preparation of the liquid developer (A1), by adjusting a ratio of the toner (1) and the dimethyl silicone oil, a liquid developer with a toner concentration of 30% is obtained.

Then, FGN85gsm (manufactured by Oji Paper Co., Ltd.) as a recording medium is prepared. By a barcoater, film-formation is performed while the liquid developer to be transferred on the recording medium is adjusted so that toner mass (TMA) and carrier liquid mass (CMA) become 3.5 g/m$^2$ and 6.0 g/m$^2$, respectively. Then, the fixing conditions are set as non-free heating at 120° C. in a non-contact manner at the first stage, and heating/pressuring at 140° C., 2.7 kg/cm$^2$ and a rate of 60 m/min by a pair of fixing rolls at the second stage, and a fixed image is formed on the recording medium.

Comparative Example IV-1

First, in the preparation of the comparative liquid developer (B1), by adjusting a ratio of the toner (1) and the paraffin oil, a comparative liquid developer with a toner concentration of 30% is obtained.

Then, the above recording medium is prepared. Film-formation is performed while the liquid developer to be transferred on the recording medium is adjusted so that toner mass (TMA), carrier liquid mass (CMA), and the process speed have the same values as those in Example IV-1. Then, according to the same fixing conditions as above, a fixed image is formed on the recording medium.

Image Durability Evaluation Test

Fixed image surfaces of the recording medium on which the fixed images has been formed as above overlap, and a fixed image surface and a recording medium side surface overlap, and they are left in a thermostatic oven (temperature 60° C., humidity 50%) for one day with application of load of 80 g/cm$^2$. Then, the superimposed surfaces are released, and it is observed if destruction (image loss or image shift) of a fixed layer at the time of release occurs. The evaluation is performed according to the following evaluation criteria. The result is noted in Table 3 below.

G5.0: no adhesion occurs.

G4.5: sound occurs at the time of release, but no image loss or shift occurs.

G4.0: very minor image loss or shift occurs (at enlarged observation, at least one loss is confirmed)

G3.0: in an area of ⅓ or less, image loss or shift occurs.

G2.0: in an area of greater than ⅓ to ½ or less, image loss or shift occurs.

G1.0: in an area of greater than ½, image loss or shift occurs.

TABLE 3

| | | | image durability | |
|---|---|---|---|---|
| | Carrier liquid | ΔSP(tc) | fixed image surfaces to each other | fixed image surface to recording medium side surface |
| Example IV-1 | Silicone oil | 1.8 | G4.5 | G4.0 |
| Comparative Example IV-1 | Paraffin oil | 1.1 | G1.0 | G1.0 |

As noted in Table 3, it can be found that Example IV-1 in which silicone oil having ΔSP(tc) of 1.8 is used shows an improvement in image durability as compared to Comparative Example IV-1 in which paraffin oil having of 1.1 is used.

Evaluation Test V: Fixability Evaluation

A liquid developer (carrier liquid: dimethyl silicone oil) which uses a toner (the toner 1) having a ratio G'(65)/G'(90) of a storage modulus G'(65) at 65° C. to a storage modulus G'(90) at 90° C. within the above range, and a comparative liquid developer (carrier liquid: dimethyl silicone oil) which uses a toner having a ratio G'(65)/G'(90) out of the above range are used to form fixed images, and fixability is evaluated.

Example V-1

First, in the preparation of the liquid developer (A1), by adjusting a ratio of the toner (1) and the dimethyl silicone oil, a liquid developer with a toner concentration of 30% is obtained.

As described above, the toner (1) has a storage modulus G'(65) at 65° C. of $7\times10^7$ Pa, and a storage modulus G'(90) at 90° C. of $3\times10^5$ Pa, and a ratio G'(65)/G'(90) of storage modulus G'(65) to storage modulus G'(90) of $2.3\times10^2$. The toner (1) has a SP value of 9.0.

Then, an experimental model of an image forming apparatus for liquid development (its fixing device has a configuration where the fixation is performed in two stages, that is, a toner image is heated by a halogen heater in a non-contact manner at a first stage, and is further heated and pressurized by a pair of fixing rolls at a second stage) is prepared, and the liquid developer is filled while FGN85gsm (manufactured by Oji Paper Co., Ltd.) as a recording medium is loaded. When the development is performed, toner mass (TMA) and carrier liquid mass (CMA) are adjusted so that they become 3.5 g/m$^2$, and 3.5 g/m$^2$ respectively at the time of transfer of the liquid developer on the recording medium. After the process speed is set as 80 m/min, and the fixing conditions are set as non-contact heating at 120° C. at the first stage, and heating/pressuring at 140° C. and 2.7 kg/cm$^2$ at the second stage, a fixed image is formed on the recording medium.

Comparative Example V-1

A comparative toner (2) is obtained in the same manner as in the toner (1) except that instead of the crystalline resin particle dispersion liquid (2a) in the preparation of the toner (1), an amorphous resin particle dispersion liquid 1a is used.

The storage modulus of the comparative toner (2) is obtained in the same manner as above: a storage modulus G'(65) at 65° C. is $7\times10^7$ Pa, a storage modulus G'(90) at 90° C. is $1\times10^7$ Pa, and a ratio G'(65)/G'(90) of storage modulus G'(65) to storage modulus G'(90) is $7.0\times10^0$.

When the SP value of the comparative toner (2) is obtained in the same manner as above, the SP value is 9.2.

A liquid developer is obtained in the same manner as in Example V-1 except that instead of the toner (1) in preparation of the liquid developer in Example V-1, the comparative toner (2) is used.

Then, as an image forming apparatus for liquid development, the above apparatus is prepared, and the comparative liquid developer is filled while the recording medium is loaded. When the development is performed, toner mass (TMA), carrier liquid mass (CMA), the process speed are adjusted so that they have the same values as those in Example V-1 at the time of transfer of the liquid developer on the recording medium. Then, the fixing conditions are adjusted to be the same values as in Example V-1, and a fixed image is formed on the recording medium.

Evaluation of Fixability

The cross-sectional images of the fixed images obtained in Example V-1 and Comparative Example V-1 are photographed and observed. It is found that in the fixed image obtained in Example V-1, the fixed image does not include the carrier liquid because since the toner is efficiently molten, and separation from the carrier liquid is well performed.

In contrast to this, it is found that in the fixed image obtained from Comparative Example V-1, the toner is insufficiently molten, separation from the carrier liquid is not well performed, and thus the fixed image contains the carrier liquid.

TABLE 4

| | Toner | | | | fixability | |
|---|---|---|---|---|---|---|
| | 65° C. | 90° C. | | | | |
| | storage modulus G' (65) | storage modulus G' (90) | G' (65)/ G' (90) | ΔSP (tc) | molten toner | carrier liquid contained in fixed image |
| Example V-1 | $7\times10^7$ Pa | $3\times10^5$ Pa | $2.3\times10^2$ | 1.8 | Good | Not observed |
| Comparative Example V-1 | $7\times10^7$ Pa | $1\times10^7$ Pa | $7.0\times10^0$ | 2.0 | Poor | Exist |

In Comparative Example V-1, a test for increasing the fixing temperature (the fixing temperature in each of the first and second stages) is performed so that the same fixability as in Example V-1 is obtained. It is required to increase the temperature up to 130° C. at the first stage, and up to 170° C. at the second stage (pair of fixing rolls).

However, it is found that around the range from 140° C. to 150° C., a blister occurs and at the above fixing temperature, a fixation window does not exist. Also, it is found that at the above fixing temperature, thermal deformation occurs in the recording medium (paper) when the device is stopped.

Evaluation Test (VI): Affinity Evaluation of a Toner, a Carrier Liquid and a Recording Medium In the two kinds of carrier liquids below, the affinities with the above toner (1) and the recording medium are evaluated.

Example VI-1 toner: the above toner (1) (SP value: 9.0)

carrier liquid: dimethyl silicone oil (manufactured by Shinetsu Silicone, KF-96-20cs, SP value: 7.2)

recording medium: manufactured by Oji Paper Co., Ltd, trade name: FGN85gsm (SP value: 15.7)

A difference ΔSP(pt) in SP value between the recording medium and the toner is 6.7, and a difference ΔSP(pc) in SP value between the recording medium and the carrier liquid is 8.5.

Figure 8:
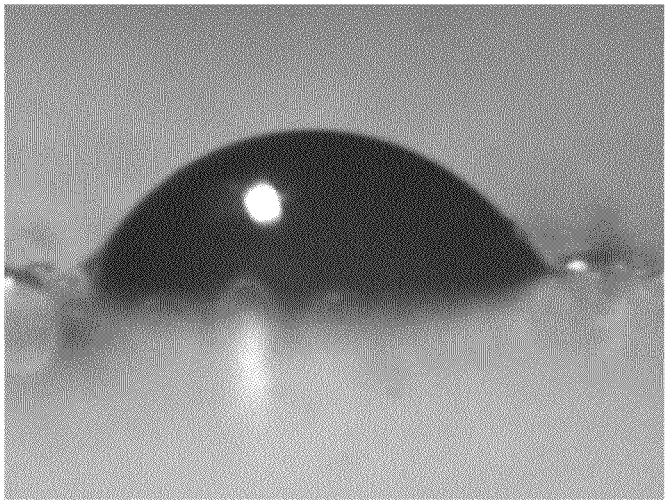
FIG. 8 is an image in a portion where a toner molten in a carrier liquid is in contact with a recording medium in Example VI-1.

In an aluminum plate, the carrier liquid (dimethyl silicone oil) is charged, and the recording medium coated with the toner is immersed in the carrier liquid, and heated at 120° C. to melt the toner. Here, an image of a portion where the toner molten in the carrier liquid is in contact with the recording medium is illustrated in FIG. 8.

Comparative Example VI-1 toner: the toner (1) (SP value: 9.0)

carrier liquid: liquid paraffin oil (MORESCO WHITE P40 manufactured by Matsumura Oil Co., Ltd, SP value: 7.9)

recording medium: manufactured by Oji Paper Co., Ltd, trade name: FGN85gsm (SP value: 15.7)

A difference ΔSP(pt) in SP value between the recording medium and the toner is 6.7, and a difference ΔSP(pc) in SP value between the recording medium and the carrier liquid is 7.8.

Figure 9:
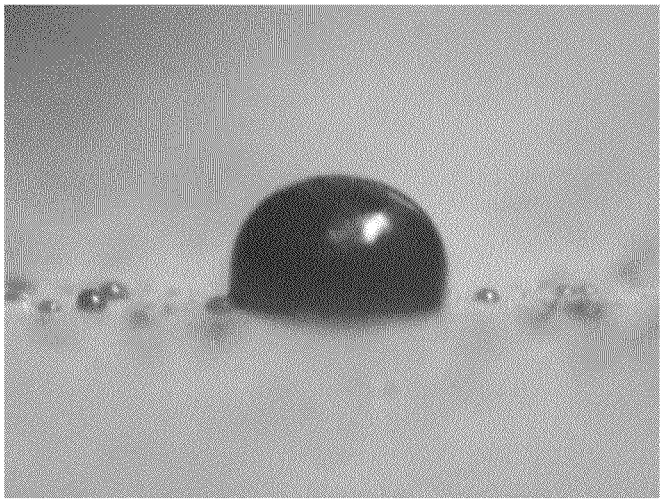
FIG. 9 is an image in a portion where a toner molten in a carrier liquid is in contact with a recording medium in Comparative Example VI-1.

In an aluminum plate, the carrier liquid (paraffin oil) is charged, and the recording medium coated with the toner is immersed in the carrier liquid, and heated at 120° C. to melt the toner. Here, an image of a portion where the toner molten in the carrier liquid is in contact with the recording medium is illustrated in FIG. 9.

It can be seen that as the contact angle between the toner and the recording medium is decreased, the affinity of the toner with the recording medium is increased, and the affinity of the toner with the carrier liquid is decreased. As illustrated in FIGS. 8 and 9, a smaller contact angle is obtained in the dimethyl silicone oil as compared in the paraffin oil when a difference ΔSP(pc) of SP value between the dimethyl silicone oil and the recording medium is higher than that between the paraffin oil and the recording medium.

What is claimed is:

1. A liquid developer containing:

a toner that has a ratio G' (65)/G'(90) of a storage modulus G' (65) at 65° C. to a storage modulus G' (90) at 90° C. of from $1\times10$ to $5\times10^2$, and a carrier liquid that has a difference of solubility parameter (SP) value between the carrier liquid and the toner (ΔSP (tc)) of from 1.5 to 7.0, wherein SP is the square root of density of cohesive energy.

2. The liquid developer according to claim 1, wherein the carrier liquid is selected from a silicon oil and a polyol.

3. The liquid developer according to claim 2, wherein the silicon oil is selected from the group consisting of dimethyl silicone oil, methyl hydrogen silicone oil and methyl phenyl silicone oil.

4. The liquid developer according to claim 2, wherein the polyol is selected from the group consisting of ethylene glycol, diethylene glycol and propylene glycol.

5. A liquid developer cartridge that contains the liquid developer according to claim 1, and is detachable from an image forming apparatus.

6. A process cartridge which is provided with a developing device that contains the liquid developer according to claim 1, and forms a toner image by developing an electrostatic latent image formed on a surface of an electrostatic latent image holding member by the liquid developer; and is detachable from an image forming apparatus.

7. An image forming method comprising:

charging a surface of an electrostatic latent image holding member;

forming an electrostatic latent image on the surface of the electrostatic latent image holding member, developing the electrostatic latent image formed on the surface of the electrostatic latent image holding member by the liquid developer according to claim 1 to form a toner image;

transferring the toner image on a recording medium; and fixing the toner image on the recording medium by heating and pressurizing the toner image on the recording medium.

8. The image forming method according to claim 7, wherein a difference of SP value between the recording medium and the toner (ΔSP(pt)) is less than a difference of SP value between the recording medium and the carrier liquid (ΔSP(pc)).

9. An image forming apparatus comprising:

an electrostatic latent image holding member;

a charging device that charges a surface of the electrostatic latent image holding member;

a latent image forming device that forms an electrostatic latent image on the surface of the electrostatic latent image holding member;

a developing device that stores the liquid developer according to claim 1, and develops the electrostatic latent image formed on the surface of the electrostatic latent image holding member by the liquid developer to form a toner image;

a transfer device that transfers the toner image on a recording medium; and a fixing device that heats and pressurizes the toner image on the recording medium to fix the toner image on the recording medium.

10. The image forming apparatus according to claim 9, wherein a difference of SP value between the recording medium and the toner (ΔSP(pt)) is less than a difference of SP value between the recording medium and the carrier liquid (ΔSP(pc)).

* * * * *